US008156882B2

(12) United States Patent
Ito

(10) Patent No.: US 8,156,882 B2
(45) Date of Patent: Apr. 17, 2012

(54) MARINE VESSEL STEERING APPARATUS AND MARINE VESSEL INCLUDING THE SAME

(75) Inventor: Makoto Ito, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 211 days.

(21) Appl. No.: 12/616,230

(22) Filed: Nov. 11, 2009

(65) Prior Publication Data

US 2010/0116190 A1 May 13, 2010

(30) Foreign Application Priority Data

Nov. 12, 2008 (JP) ..... 2008-289907

(51) Int. Cl.
*B63H 25/00* (2006.01)

(52) U.S. Cl. ..... 114/144 RE; 701/21

(58) Field of Classification Search ..... 114/144 R, 114/144 RE, 151; 440/84; 701/21
See application file for complete search history.

(56) References Cited

U.S. PATENT DOCUMENTS 5,107,424 A * 4/1992 Bird et al. ..... 701/21
5,253,604 A * 10/1993 Bohlin ..... 114/144 R
7,270,068 B2 * 9/2007 Mizutani ..... 114/144 RE
7,512,465 B2 * 3/2009 Gai ..... 701/21
2007/0089661 A1 4/2007 Yazaki et al.

FOREIGN PATENT DOCUMENTS

JP 2005-280572 A 10/2005

* cited by examiner

*Primary Examiner* — Lars A Olson
(74) *Attorney, Agent, or Firm* — Keating & Bennett, LLP

(57) ABSTRACT

A marine vessel steering apparatus includes a rudder unit arranged to be mounted pivotally on a hull, an actuator arranged to turn the rudder unit, a rudder angle sensor arranged to detect the rudder angle of the rudder unit, a steering wheel arranged to be operated by an operator to steer the rudder unit, a wheel angle detecting unit arranged to detect the amount of change in the rotation angle of the steering wheel, and a control unit arranged to perform steering control by controlling the actuator based on values detected by the rudder angle sensor and the wheel angle detecting unit. The control unit is arranged to set the rudder angle of the rudder unit detected by the rudder angle sensor at the start of steering control corresponding to the steering wheel as an initial target rudder angle and compute a target rudder angle based on the initial target rudder angle and the change in the rotation angle of the steering wheel, and to control the actuator to change the rudder angle of the rudder unit in accordance with the target rudder angle.

32 Claims, 13 Drawing Sheets

MARINE VESSEL STEERING APPARATUS AND MARINE VESSEL INCLUDING THE SAME

BACKGROUND OF THE INVENTION

1. Field of the Invention

The present invention relates to a marine vessel steering apparatus and a marine vessel including the same. The marine vessel steering apparatus turns a rudder unit by an actuator controlled according to the operation of a steering wheel. The rudder unit is arranged to be mounted pivotally on a hull. One example of the rudder unit is an outboard motor with a built-in propulsion unit.

2. Description of Related Art

U.S. Patent Application Publication No. 2007/0089661 A1 discloses a prior art outboard motor steering control system. This system includes an actuator for turning an outboard motor with respect to a hull. The actuator is controlled electrically based on a value detected by a wheel angle sensor.

In the prior art above, the rotation angle of the steering wheel and the rudder angle of the outboard motor are detected when the internal-combustion engine included in the outboard motor starts. If there is a phase difference between the rotation angle of the steering wheel and the rudder angle of the outboard motor, phase difference elimination control is performed. The phase difference elimination control is for eliminating the phase difference between the rotation angle of the steering wheel and the rudder angle of the outboard motor. In this case, the outboard motor automatically moves, which may be unexpected by an operator. Hence, the prior art is arranged to inform the operator of the direction and/or magnitude of the phase difference when performing the phase difference elimination control.

SUMMARY OF THE INVENTION

The inventor of preferred embodiments of the present invention described and claimed in the present application conducted an extensive study and research regarding a marine vessel steering apparatus, such as the one described above, and in doing so, discovered and first recognized new unique challenges and previously unrecognized possibilities for improvements as described in greater detail below.

That is, in accordance with the prior art mentioned above, the outboard motor automatically moves when performing the phase difference elimination control, even though the operator is informed of the direction and/or magnitude of the phase difference. Although the operator is informed of this movement, the operator and other crew members or passengers may prefer to avoid such automatic movement.

Also, although not disclosed in the prior art document, the inventor of the present application has also considered the case where the phase difference elimination control is performed not only when the internal-combustion engine starts but also, for example, when the controller for controlling the actuator is reset. For example, there may be a case where the controller is stopped temporarily due to noise occurring inside the outboard motor and then reset automatically to restart the operation of controlling the actuator. In this case, the outboard motor will turn when the phase difference elimination control is performed with the restart of the actuator control. Therefore the operator and other crew members or passengers will experience such movement after being informed that the movement will occur. Further, the operator has to wait for the completion of the phase difference elimination control before initiating the steering operation.

Furthermore, although also not disclosed in the prior art document, the inventor of the present application has further considered the case where the phase difference elimination control is performed when the controller is powered on. In this case, the outboard motor turns automatically with the power-on operation, which may not be desired by persons near the outboard motor. Further, the operator has to wait for the completion of the phase difference elimination control before initiating the steering operation. Also, when performing onshore maintenance for the marine vessel, if the automatic turning of the outboard motor after the power-on operation is performed, it may make the maintenance work difficult.

In order to overcome the previously unrecognized and unsolved challenges described above, a preferred embodiment of the present invention provides a marine vessel steering apparatus including a rudder unit, an actuator, a rudder angle sensor, a steering wheel, a wheel angle detecting unit, and a control unit. The rudder unit is arranged to be mounted pivotally on a hull. The actuator is arranged to turn the rudder unit. The rudder angle sensor is arranged to detect the rudder angle of the rudder unit. The steering wheel is arranged to be operated by an operator to steer the rudder unit. The wheel angle detecting unit is arranged to detect the amount of change in the rotation angle of the steering wheel. The control unit is arranged to perform steering control by controlling the actuator based on values detected by the rudder angle sensor and the wheel angle detecting unit. The control unit is specifically arranged to set the rudder angle of the rudder unit detected by the rudder angle sensor at the start of steering control corresponding to the steering wheel as an initial target rudder angle and compute a target rudder angle based on the initial target rudder angle and the change in the rotation angle of the steering wheel, and to control the actuator to change the rudder angle of the rudder unit in accordance with the target rudder angle. The change in the rotation angle of the steering wheel may be the amount of change in the rotation angle of the steering wheel after the start of steering control corresponding to the steering wheel. Alternatively, the change in the rotation angle of the steering wheel may be the amount of change in the rotation angle of the steering wheel within a predetermined time period (i.e., rate of change).

In accordance with the arrangement above, the relationship between the rotation angle of the steering wheel and the rudder angle of the rudder unit at the start of steering control corresponding to the steering wheel is accepted as it is as an initial state. Specifically, the rudder angle of the rudder unit at the start of steering control corresponding to the steering wheel is set as an initial target rudder angle. Then, if the change in the rotation angle of the steering wheel occurs, the change and the initial target rudder angle are used to compute a target rudder angle. The actuator is controlled in accordance with the target rudder angle to change the rudder angle of the rudder unit. As a result, the rotation angle of the steering wheel at the start of steering control corresponding to the steering wheel is set according to the rudder angle of the rudder unit at that time (actual rudder angle). It is therefore possible to set, as an initial state (where there is no phase difference between the rotation angle of the steering wheel and the rudder angle of the rudder unit), the state of the relationship between the rotation angle of the steering wheel and the rudder angle of the rudder unit at the time of starting the steering control, no matter what the relationship is. This can prevent the actuator from being driven at the start of steering control. This can accordingly satisfy the operator and other crew members or passengers wishing to avoid such movement of the rudder unit. Also, since the actuator is controlled to change the rudder angle of the rudder unit in accordance with the change in the rotation angle of the steering wheel, the rudder angle of the rudder unit is changed in accordance with the rotation of the steering wheel by the operator after the start of the steering control. Therefore, the operator can steer the rudder according to his/her intention and thus, can readily and easily initiate the steering operation therefore.

The rudder angle sensor is preferably arranged to detect the rudder angle of the rudder unit as an absolute angle. The wheel angle detecting unit, which is arranged to detect the amount of change in the rotation angle of the steering wheel, is arranged to detect a relative angle from an arbitrarily defined reference position (specifically, the position when the initial target rudder angle is set).

The start of the steering control preferably includes when the marine vessel steering apparatus is powered on and when the control unit is stopped temporarily and then restarted. The relationship between the rotation angle of the steering wheel and the rudder angle of the rudder unit may change relatively while the marine vessel steering apparatus is powered off or the control unit is stopped temporarily. Even in such a case, the state when the apparatus is powered on or the control unit is restarted is accepted as it is as an initial state, whereby there can be no possibility that the rudder unit moves.

In the case above, every time the marine vessel steering apparatus is powered on and the control unit is stopped temporarily and then restarted, the control unit is to set the rudder angle of the rudder unit at that time as an initial target rudder angle.

A preferred embodiment of the present invention preferably includes multiple steering wheels. In this case, the start of the steering control includes when steering control corresponding to one of the multiple steering wheels is switched to steering control corresponding to another steering wheel. That is, when the steering control corresponding to another steering wheel is started, the rudder angle of the rudder unit at the time is set as an initial target rudder angle. With this arrangement, when steering by one steering wheel is switched to steering by another steering wheel, the relationship between the rotation angle of the steering wheel and the rudder angle of the rudder unit after the switching is accepted as it is as an initial state. It is therefore possible to prevent the rudder unit from moving.

In the case above, every time steering control corresponding to one of the multiple steering wheels is switched to steering control corresponding to another steering wheel, the control unit is to set the rudder angle of the rudder unit at that time as an initial target rudder angle.

The steering wheels preferably includes a first steering wheel and a second steering wheel that are arranged independently pivotally of each other. In this case, the wheel angle detecting unit preferably includes a first wheel angle detecting unit arranged to detect the amount of change in the rotation angle of the first steering wheel and a second wheel angle detecting unit arranged to detect the amount of change in the rotation angle of the second steering wheel. More preferably, the marine vessel steering apparatus further includes a switching unit arranged to instruct the control unit to switch between first steering control in which the actuator is controlled based on a value detected by the first wheel angle detecting unit and second steering control in which the actuator is controlled based on a value detected by the second wheel angle detecting unit. In this case, the control unit is preferably arranged, when instructed by the switching unit to switch from the first steering control to the second steering control, to set the rudder angle of the rudder unit detected by the rudder angle sensor as an initial target rudder angle when switching and compute a target rudder angle based on the initial target rudder angle and the change in the rotation angle of the second steering wheel, and to control the actuator to change the rudder angle of the rudder unit in accordance with the target rudder angle. With this arrangement, operating the switching unit allows the first steering control in which the first steering wheel is used for steering to be switched to the second steering control in which the second steering wheel is used for steering. In this case, the relationship between the rotation angle of the second steering wheel and the rudder angle of the rudder unit when the switching unit instructs to switch the control is accepted as it is as an initial state. It is therefore possible to prevent the rudder unit from moving. The operator can readily initiate the steering operation on the second steering wheel after switching of the steering control.

The control unit is preferably arranged, when instructed by the switching unit to switch from the second steering control to the first steering control, to set the rudder angle of the rudder unit detected by the rudder angle sensor as an initial target rudder angle when switching, and compute a target rudder angle based on the initial target rudder angle and the change in the rotation angle of the first steering wheel, and to control the actuator to change the rudder angle of the rudder unit in accordance with the target rudder angle. With this arrangement, the relationship between the rotation angle of the first steering wheel and the rudder angle of the rudder unit when instructed to switch the control is accepted as it is as an initial state. It is therefore possible to prevent the rudder unit from moving. The operator can readily initiate the steering operation on the first steering wheel after switching of the steering control.

In a preferred embodiment of the present invention, the rudder unit is arranged to hold the rudder angle thereof when the steering control is in a stopped state, and the steering wheel is arranged to be rotatable independently of the rudder angle of the rudder unit when the steering control corresponding to the steering wheel is in a stopped state. With this arrangement, when the steering wheel is operated while the steering control corresponding to the steering wheel is stopped, the relationship between the rotation angle of the steering wheel and the rudder angle of the rudder unit may change. However, this change in the relationship cannot have any negative impact when the steering control is restarted thereafter. That is, since the initial target rudder angle is reset at the restart of the steering control, the relationship after the change is accepted as it is as an initial state. This prevents the actuator from being driven at the start of steering control, which is beneficial for the operator and other crew members or passengers, especially since the operator can readily initiate the steering operation.

A marine vessel steering apparatus according to a preferred embodiment of the present invention further includes a locking mechanism arranged to lock the rotation of the steering wheel. In this case, the control unit is preferably arranged, when the rudder angle of the rudder unit detected by the rudder angle sensor is out of a preset angular range, to control the locking mechanism to lock the steering wheel regardless of the rotational position of the steering wheel. With this arrangement, the rotational position of the steering wheel at the start of the steering control is not involved in the locking control of the steering wheel. Instead, the locking control of the steering wheel is performed based on the actual rudder angle of the rudder unit. This allows the steering wheel to be locked appropriately.

In a preferred embodiment of the present invention, the control unit is arranged, after the start of steering control corresponding to the steering wheel, to reset the rudder angle of the rudder unit detected by the rudder angle sensor as an initial target rudder angle at predetermined time intervals and compute a target rudder angle based on the initial target rudder angle and the change in the rotation angle of the steering wheel, and to control the actuator to change the rudder angle of the rudder unit in accordance with the target rudder angle. With this arrangement, even if there may be a delay in the actual rudder angle (actual rudder angle of the rudder unit) following the target rudder angle, the delay in following (delay in response) can be eliminated periodically. This allows the phase shifting between the steering wheel and the rudder unit to be eliminated periodically, whereby the operation of the steering wheel can be matched with the turning behavior of the rudder unit.

A preferred embodiment of the present invention provides a marine vessel including a hull and such a marine vessel steering apparatus as mentioned above provided on the hull. This arrangement provides for a much more desirable and comfortable movement of the rudder unit as compared to the prior art, which benefits and increases the comfort of the operator and other crew members or passengers.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
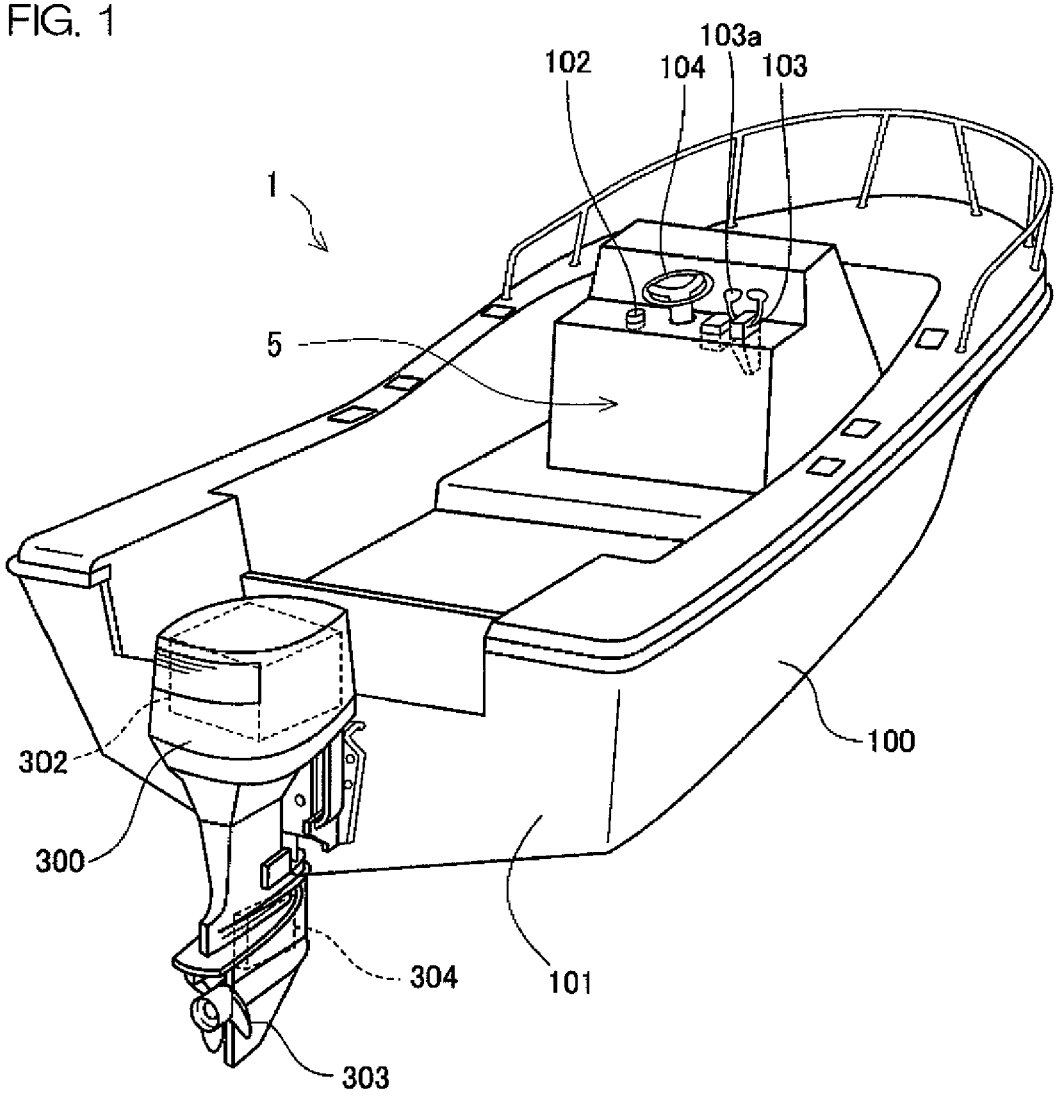
FIG. 1 is a perspective view of a marine vessel including a marine vessel steering apparatus according to a first preferred embodiment of the present invention.
Figure 2:
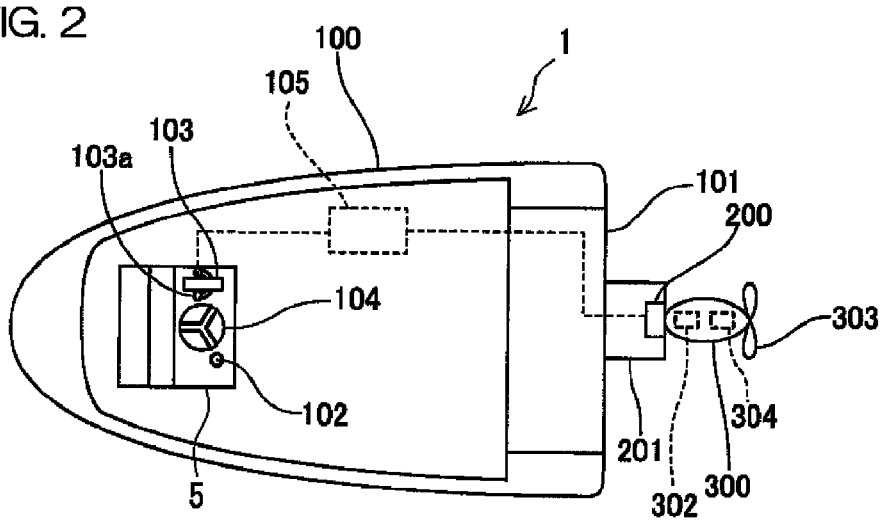
FIG. 2 is a schematic plan view of the marine vessel.
Figure 3:
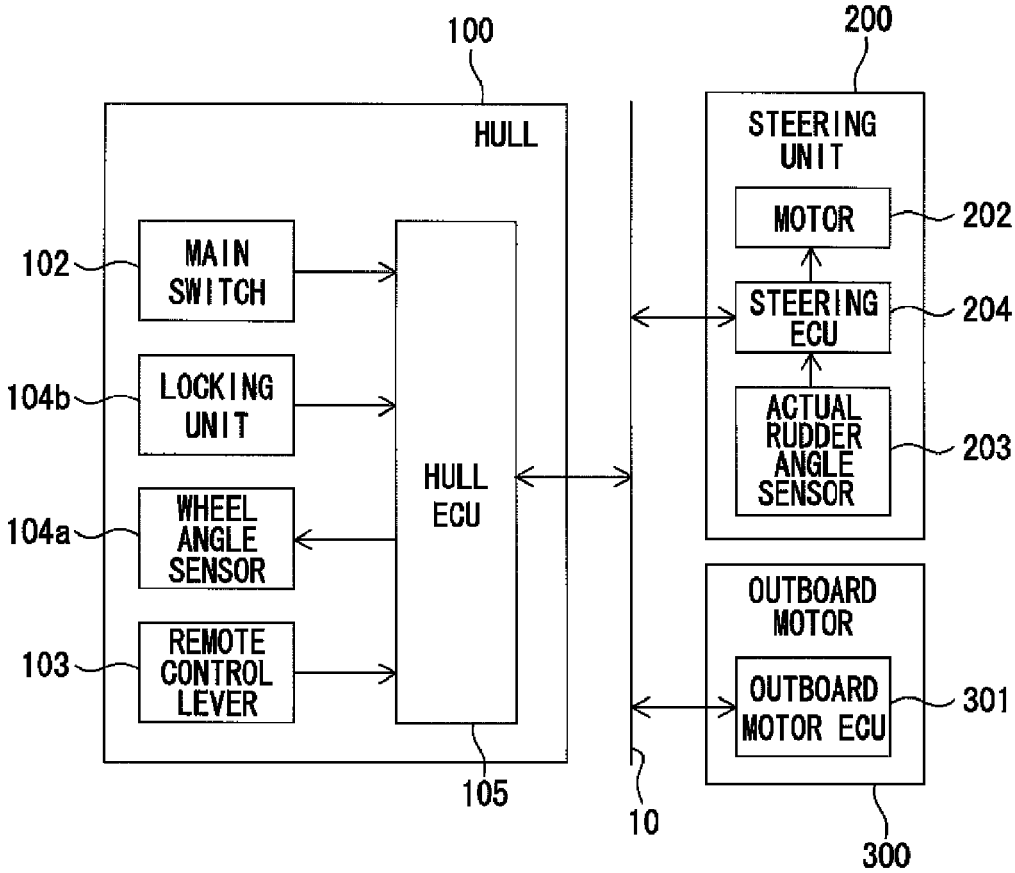
FIG. 3 is a block diagram of the marine vessel steering apparatus.

FIGS. 1 to 3 show the overall configuration of a marine vessel including a marine vessel steering apparatus according to a first preferred embodiment of the present invention.

The marine vessel 1 according to the first preferred embodiment includes a hull 100, a steering unit 200, and an outboard motor 300. The outboard motor 300 is mounted at the stern 101 of the hull 100 via the steering unit 200. The hull 100 has a marine vessel maneuvering station 5 provided, for example, at the front portion thereof. The marine vessel maneuvering station 5 has a main switch 102, a remote control lever unit 103, a steering wheel 104, a trim switch (not shown), and the like arranged thereon.

The main switch 102 is arranged to be operated by a marine vessel maneuvering operator to switch between power-on and -off of a marine vessel propulsion system. The marine vessel propulsion system includes the steering wheel 104, steering unit 200, outboard motor 300, and a control unit therefore, and is corresponding to a marine vessel steering apparatus according to one preferred embodiment of the present invention. The remote control lever unit 103 is arranged to be operated by the operator for direction of throttle opening degree and shift switching. The steering wheel 104 is arranged to be rotationally operated by the operator to change the heading direction of the hull 100. The trim switch is arranged to be operated by the operator to change the mounting angle (on a vertical plane) of the outboard motor 300 with respect to the hull 100. The remote control lever unit 103 includes an operation lever 103*a* arranged to be rotationally operated in the front/rear direction by the operator. With the rotation of the operation lever 103*a*, the shift of the outboard motor 300 can be switched from among neutral, forward, and reverse. Further, with the rotation of the operation lever 103*a*, accelerator operation can be performed (throttle opening degree can be changed) for an engine 302 included in the outboard motor 300.

The steering wheel 104 is operated by the operator for steering of the marine vessel 1. The steering wheel 104 is arranged to be rotatable any number of times independently of the rudder angle of the outboard motor 300 when the marine vessel propulsion system is powered off. The steering wheel 104 is provided with a wheel angle sensor 104*a* for use in detecting the amount of change in the rotation angle of the steering wheel 104. The wheel angle sensor 104*a* is arranged to detect the rotation angle of the steering wheel 104 as a relative angle with respect to a given reference position. That is, the wheel angle sensor 104*a* has no fixed reference point (zero-degree position) and is arranged to detect a relative angle with respect to a variable reference point. The steering wheel 104 is further provided with a locking unit 104*b* to be controlled to lock the rotation of the steering wheel 104 when the rudder angle of the outboard motor 300 is maximized during steering.

Figure 17:
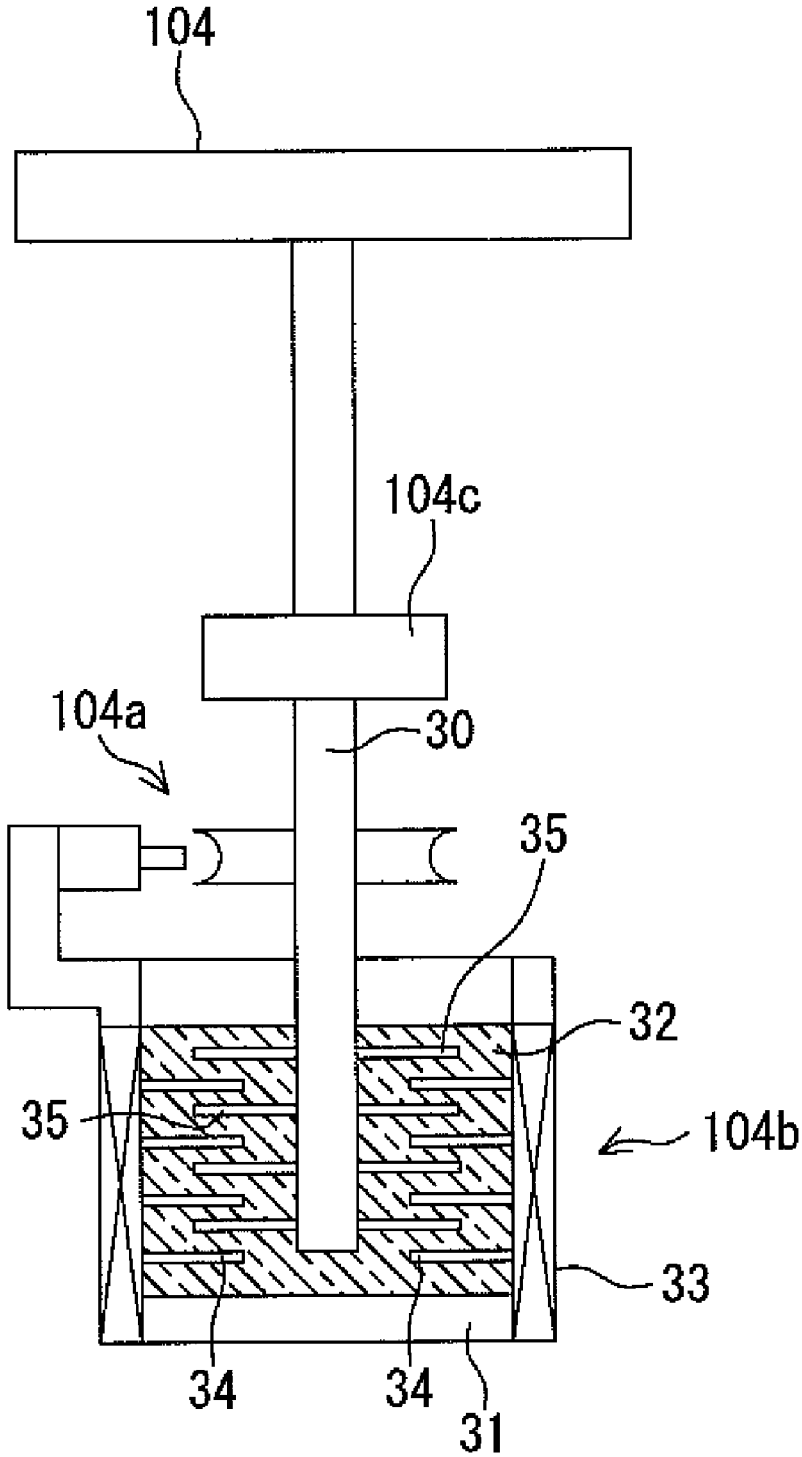
FIG. 17 is a graphical cross-sectional view showing a construction example of a locking unit for locking a steering wheel.

As shown in FIG. 17, the locking unit 104*b* includes, for example, a magnetic fluid holder 31 fixed to the hull 100, magnetic fluid 32 put in the magnetic fluid holder 31, and a coil 33 wound around the magnetic fluid 32. The lower end portion of a wheel shaft 30 is inserted in the magnetic fluid holder 31. The magnetic fluid 32 has a property that the viscosity thereof varies depending on the magnitude of a magnetic field. The locking unit 104*b* is arranged to change the viscosity of the magnetic fluid 32 by energizing the coil 33, and thereby to add friction to the motion of the wheel shaft 30. Also, plates 34 and 35 are fixed, respectively, to the magnetic fluid holder 31 and the wheel shaft 30. These plates 34 and 35 make it possible to add friction by the magnetic fluid 32 effectively to the wheel shaft 30. The locking unit 104*b* is an example of a "locking mechanism" according to one preferred embodiment of the present invention.

The wheel angle sensor 104*a* is installed on the wheel shaft 30. A torque sensor 104*c* may also be installed on the wheel shaft 30, if needed.

Referring to FIG. 2, the steering unit 200 is mounted at the stern 101 of the hull 100 via a clamp bracket 201. The steering unit 200 includes a motor 202 arranged to turn the outboard motor 300 during steering, an actual rudder angle sensor 203 arranged to detect the turning angle (actual rudder angle) of the outboard motor 300, and a steering ECU (electronic control unit) 204. The steering unit 200 is arranged to change the direction of a propeller 303 by swinging (turning) the main body of the outboard motor 300 right and left. This causes the direction of propulsive forces generated by the propeller 303 of the outboard motor 300 to be swung right and left and thereby the heading direction of the hull 100 to be changed. The actual rudder angle sensor 203 is arranged to detect the turning angle (actual rudder angle) of the outboard motor 300 as an absolute angle. That is, the actual rudder angle sensor 203 has a fixed reference point (zero-degree position) and is arranged to detect an angle with respect to the reference point. The motor 202 and the actual rudder angle sensor 203 are coupled to the steering ECU 204. The steering ECU 204 is arranged to control the motor 202 such that the actual rudder angle detected by the actual rudder angle sensor 203 is made equal to a target rudder angle. The motor 202 and the actual rudder angle sensor 203 are, respectively, examples of "actuator" and "rudder angle sensor" according to one preferred embodiment of the present invention. The outboard motor 300 is also an example of a "rudder unit" according to one preferred embodiment of the present invention.

The outboard motor 300 is mounted laterally pivotally at the stern 101 of the hull 100 via the steering unit 200. The outboard motor 300 includes an outboard motor ECU (electronic control unit) 301, engine 302, propeller 303 to be rotated by a driving force from the engine 302, and a forward-reverse switching mechanism portion 304. The forward-reverse switching mechanism portion 304 is arranged to be capable of switching between a transmitting state (forward driving or reverse driving state) where a driving force is transmitted from the engine 302 to the propeller 303 and a blocking state (neutral state) where a driving force from the engine 302 is blocked off from the propeller 303. The rotational speed of the engine 302 and the shifting of the forward-reverse switching mechanism portion 304 are controlled by the outboard motor ECU 301.

The hull 100 is equipped with a hull ECU (electronic control unit) 105. The hull ECU 105 constitutes an example of a "control unit" according to one preferred embodiment of the present invention together with the steering ECU 204. The hull ECU 105 is arranged to be capable of communicating information with the steering ECU 204 and the outboard motor ECU 301 via an inboard LAN (local area network) 10 built in the marine vessel 1. Communications are provided also between the steering ECU 204 and the outboard motor ECU 301 via the inboard LAN 10.

The hull ECU 105 includes a microcomputer and is arranged to drive and control the motor 202 in the steering unit 200 and the locking unit 104*b* based on the amount of change in the rotation angle (rotation amount) detected using the wheel angle sensor 104*a* and an actual rudder angle detected by the actual rudder angle sensor 203. More specifically, the hull ECU 105 receives a signal from the wheel angle sensor 104*a* and acquires an actual rudder angle detected by the actual rudder angle sensor 203 from the steering ECU 204 via the inboard LAN 10. Based on these signals, the hull ECU 105 then computes a target rudder angle of the outboard motor 300 and transfers the target rudder angle to the steering ECU 204. The wheel angle sensor 104*a* and the hull ECU 105 constitute an example of the "wheel angle detecting unit" according to one preferred embodiment of the present invention.

In the hull ECU 105, an amount of change in the target rudder angle by which the outboard motor 300 is to be turned is preset as correspondence values corresponding to each amount of change in the rotation angle of the steering wheel 104. Correspondence values are set in such a manner, for example, that when the steering wheel 104 is rotated approximately two and a half times (about 900 degrees), the outboard motor 300 is turned by approximately 30 degrees, for example. These correspondence values may be mapped to define the correspondence relationships. This map may be modified depending on running situations of the marine vessel (e.g., marine vessel velocity, wheel operation speed, and failure detection states). Alternatively, a specific operation based on running situations of the marine vessel may be implemented for the amount of change in the rotation angle (or rotation speed) of the steering wheel 104 to set an angle (amount of change in the target rudder angle) by which the outboard motor 300 is to be turned. For example, the amount of change in the target rudder angle may be obtained by multiplying the amount of change in the rotation angle of the steering wheel 104 by a predetermined transmission ratio. In this case, the transmission ratio may be modified depending on running situations of the marine vessel.

An output signal from the remote control lever unit 103 is acquired by the hull ECU 105. This signal includes directions for switching among neutral, forward, and reverse driving and for accelerator operation. The hull ECU 105 is arranged to compute a target shift value (forward, reverse, or neutral) and a target output value (e.g., target engine speed or target throttle opening degree) according to the operation of the remote control lever unit 103. The hull ECU 105 is arranged to send the target shift value and the target output value to the outboard motor ECU 301 via the inboard LAN 10. The outboard motor ECU 301 is arranged to control the forward-reverse switching mechanism portion 304 based on the target shift value and to control the output of the engine 302 (e.g., engine speed or throttle opening degree) based on the target output value.

The hull ECU 105 is also arranged to start controlling the motor 202 in the steering unit 200 and the locking unit 104*b* when the main switch 102 is operated and the system is turned ON. Control of the motor 202 in the steering unit 200 by the hull ECU 105 (via the steering ECU 204) will hereinafter be referred to as steering control. The steering control is always performed while the hull ECU 105 operates. The hull ECU 105 (more precisely, microcomputer incorporated in the hull ECU 105) is stopped when the main switch 102 is operated to OFF. The hull ECU 105 may also be stopped temporarily when, for example, the system undergoes a rapid voltage change. In this case, the steering control by the hull ECU 105 will be restarted when the main switch 102 is operated to ON or the ECU returns automatically from such a temporary stop. For example, the hull ECU 105 reduces its functionality when the power-supply voltage is dropped temporarily, and the hull ECU 105 will then be restarted automatically when the power-supply voltage is recovered. The steering control by the hull ECU 105 will be restarted in such a case.

When the steering control is started (including the case of such a restart as mentioned above), the hull ECU 105 acquires an actual rudder angle of the outboard motor 300 at the start point from the steering ECU 204. The hull ECU 105 then sets the acquired actual rudder angle as an initial target rudder angle. This setting process is performed every time the steering control is started. On the other hand, the hull ECU 105 acquires from the wheel angle sensor 104*a* the amount of change in the rotation angle of the steering wheel 104 after the steering control is started. The hull ECU 105 further obtains an amount of change in the target rudder angle corresponding to the acquired amount of change in the rotation angle. The amount of change in the target rudder angle may be obtained using a map as mentioned above, or may be obtained through an operation using a transmission ratio and the like. The hull ECU 105 adds the thus obtained amount of change in the target rudder angle to the initial target rudder angle to compute a target rudder angle of the outboard motor 300. The hull ECU 105 then gives the target rudder angle to the steering ECU 204 via the inboard LAN 10. The steering ECU 204 controls the motor 202 such that the actual rudder angle detected by the actual rudder angle sensor 203 is made equal to the target rudder angle.

As described heretofore, the hull ECU 105 accepts the relationship between the rotational position of the steering wheel 104 (wheel angle) and the actual rudder angle of the outboard motor 300 at the start of steering control as an initial state and performs the subsequent steering control.

Figure 4:
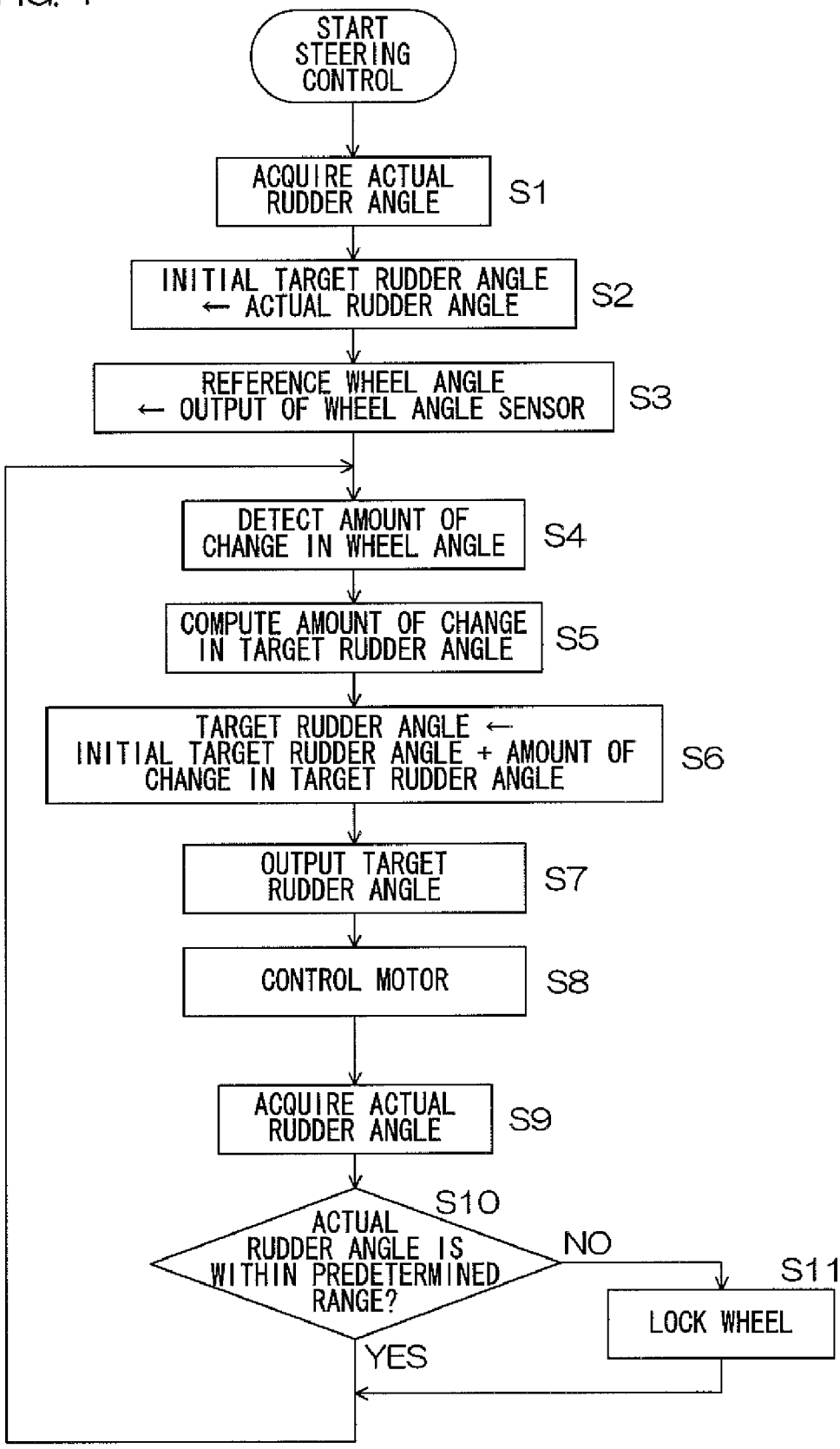
FIG. 4 is a flow chart illustrating the steering control of the marine vessel steering apparatus.
Figure 5:
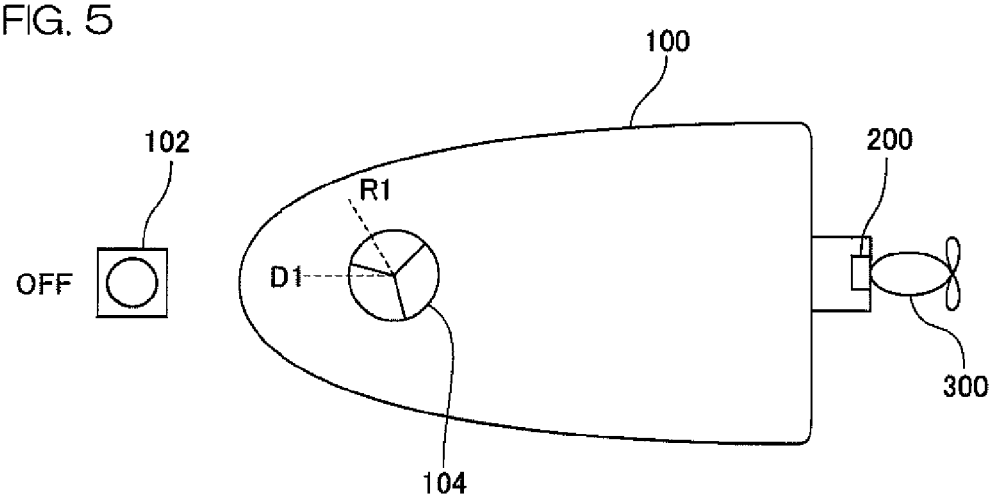
FIGS. 5, 6, and 7 are schematic plan views illustrating the steering control of the marine vessel steering apparatus.
Figure 6:
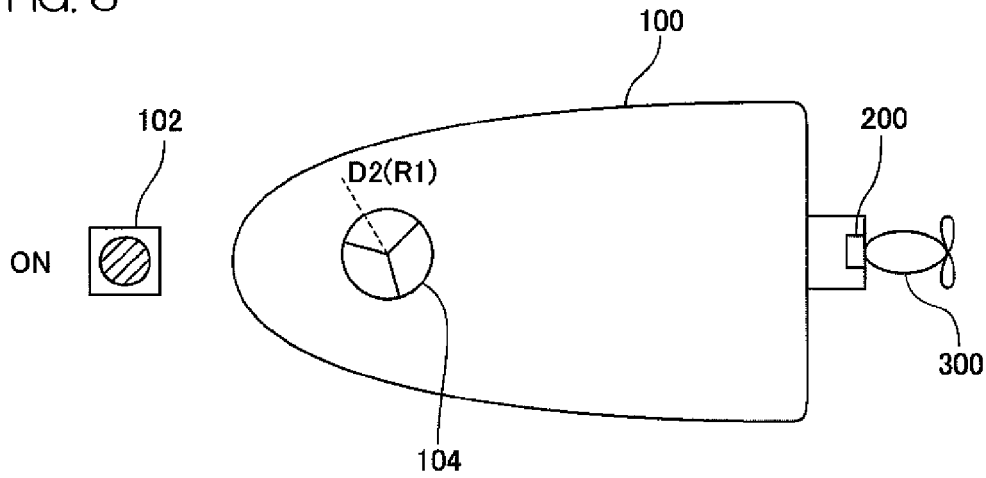
Figure 7:
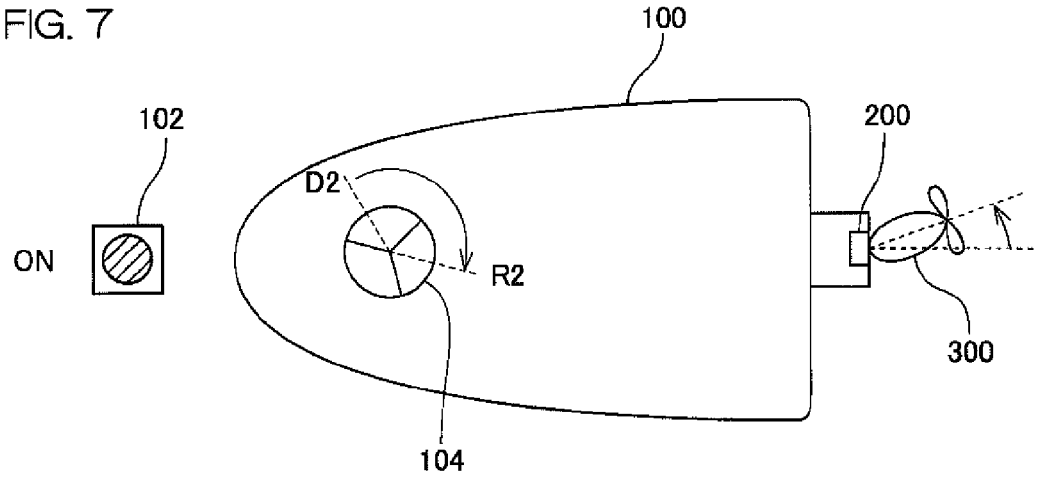

FIG. 4 is a flow chart illustrating the steering control of the marine vessel propulsion system (marine vessel steering apparatus) according to the first preferred embodiment of the present invention. FIGS. 5 to 7 are schematic views for illustrating the flow chart shown in FIG. 4.

As shown in FIG. 5, when the main switch 102 is OFF, the hull ECU 105 and the steering unit 200 do not operate, whereby the rudder angle of the outboard motor 300 is not changed. On the other hand, when the main switch 102 is OFF, the steering wheel 104 is rotatable freely. Therefore, the relationship between the actual rudder angle (phase) of the outboard motor 300 and the rotation angle (phase) of the steering wheel 104 may change relatively. The system may have an arrangement that when the main switch 102 is OFF, the steering wheel 104 is fixed non-rotatably. Even with such a system arrangement, it is impossible, when the outboard motor 300 in a turned state is mounted on another marine vessel, to ensure that there is a certain relationship between the actual rudder angle of the outboard motor 300 and the rotation angle (phase) of the steering wheel 104. In FIG. 5, the actual rudder angle of the outboard motor 300 is zero degrees (straight traveling). On the other hand, the rotation angle of the steering wheel 104 is at a turned position (indicated by R1) shifted from the original position of straight traveling (indicated by D1, where the main switch 102 is turned OFF at the last minute).

As shown in FIG. 6, when the main switch 102 is turned ON, steering control is started. That is, the hull ECU 105 acquires an actual rudder angle detected by the actual rudder angle sensor 203 (see FIG. 3) from the steering ECU 204 (Step S1 in FIG. 4). The hull ECU 105 then sets the acquired actual rudder angle as an initial target rudder angle (Step S2). Further, the hull ECU 105 stores an output from the wheel angle sensor 104*a* (see FIG. 3) at the start of the steering control as a reference wheel angle (zero-degree position) (Step S3).

Subsequently, the hull ECU 105 detects the amount of change in the wheel angle with respect to the reference wheel angle (indicated by D2) based on a signal from the wheel angle sensor 104*a* (Step S4). The hull ECU 105 also obtains an amount of change in the target rudder angle corresponding to the amount of change in the wheel angle (Step S5). The hull ECU 105 further adds the amount of change in the target rudder angle to the initial target rudder angle to obtain a target rudder angle (Step S6). The hull ECU 105 then gives the target rudder angle to the steering ECU 204 via the inboard LAN 10 (Step S7). The steering ECU 204 controls the motor 202 in such a manner that the actual rudder angle is made equal to the target rudder angle (Step S8). This causes the outboard motor 300 to be turned by an angle corresponding to the amount of change in the wheel angle with respect to the reference wheel angle (indicated by D2). In FIG. 7, the outboard motor 300 is turned from the straight traveling to a turning position in response to the steering wheel 104 being rotated from the reference wheel angle D2 to a wheel angle R2.

The hull ECU 105 further acquires the actual rudder angle of the outboard motor 300 from the steering ECU 204 (Step S9). The hull ECU 105 then determines whether or not the actual rudder angle is within a preset predetermined range (the turn limit of the outboard motor 300) (Step S10). If the actual rudder angle is within the predetermined range (approximately ±30 degrees, for example), the processing of the hull ECU 105 returns to Step S4. If the actual rudder angle is not within the predetermined range (approximately ±30 degrees, for example), the hull ECU 105 drives the locking unit 104*b* to lock the steering wheel 104 so as not to be further rotated in the turning direction (Step S11). The processing of the hull ECU 105 then returns to Step S4. During the steering control, Steps S4 to S11 are repeated at predetermined time intervals.

The processing from Step S1 to S11 is also performed at the time of restarting when the hull ECU 105 is stopped temporarily due to a rapid voltage change or the like and then restarted.

In the present first preferred embodiment, the relationship between the rotation angle of the steering wheel 104 and the rudder angle of the outboard motor 300 at the start of steering control is accepted as it is as an initial state, as mentioned above. Specifically, the actual rudder angle of the outboard motor at the start of steering control is set as an initial target rudder angle. Thereafter, when the rotation angle of the steering wheel 104 is changed, the amount of change and the initial target rudder angle are used to compute a target rudder angle. The motor 202 in the steering unit 200 is controlled based on this target rudder angle and thereby the rudder angle of the outboard motor 300 is changed. Accordingly, as a result, the rotation angle of the steering wheel 104 at the start of steering control is made correspondent to the rudder angle of the outboard motor 300. It is therefore possible to set the relationship between the rotation angle of the steering wheel 104 and the rudder angle of the outboard motor 300 at the start of steering control as an initial state (where there is no phase difference between the rotation angle of the steering wheel 104 and the rudder angle of the outboard motor 300). This can prevent the motor 202 in the steering unit 200 from being driven at the start of steering control. This can accordingly provide the operator and other crew members or passengers a more comfortable experience. Also, because the motor 202 in the steering unit 200 is controlled to change the rudder angle of the outboard motor 300 in accordance with the amount of change in the rotation angle of the steering wheel 104, the rudder angle of the outboard motor 300 is changed in accordance with the rotation of the steering wheel 104 by the operator after the start of the steering control. Therefore, the operator can steer the rudder to his/her intention. The operator can readily initiate the steering operation.

Also, in the present first preferred embodiment, the actual rudder angle sensor 203 detects the rudder angle of the outboard motor 300 as an absolute angle, and the wheel angle sensor 104*a* detects the amount of change in the rotation angle of the steering wheel 104 as a relative angle, as mentioned above. This allows the amount of change in the rotation angle of the steering wheel 104 to be detected as a relative angle from an arbitrarily reference wheel angle. Therefore, the rudder angle of the outboard motor 300 can be changed easily in accordance with the amount of change in the rotation angle of the steering wheel 104.

Further, in the present first preferred embodiment, when the hull ECU 105 is stopped temporarily during the operation of the steering wheel 104 and then restarted, the actual rudder angle at the start (restart) of the steering control is set as an initial target rudder angle, as mentioned above. Therefore, there occurs no problem even if the rudder angle of the outboard motor 300 may be held during the temporary stop of the hull ECU 105, while the steering wheel 104 may be kept rotated. That is, the rotation of the steering wheel 104 during the stop of the hull ECU 105 does not appear in the turning motion of the outboard motor 300. If the rotation of the steering wheel 104 during the stop of the hull ECU 105 were reflected in the motion of the outboard motor 300 after the restart of the steering control by the hull ECU 105, the outboard motor 300 would be automatically turned when the hull ECU 105 is restarted. Such an unintended turning motion cannot occur in the present preferred embodiment.

Also, in the present first preferred embodiment, the control of locking the steering wheel 104 is performed independently of the rotation angle of the steering wheel 104 at the start of the steering control, as mentioned above. That is, the control of locking the steering wheel 104 is performed when the actual rudder angle of the outboard motor 300 becomes out of a preset angular range. This allows the steering wheel 104 to be locked appropriately.

Second Preferred Embodiment

Figure 8:
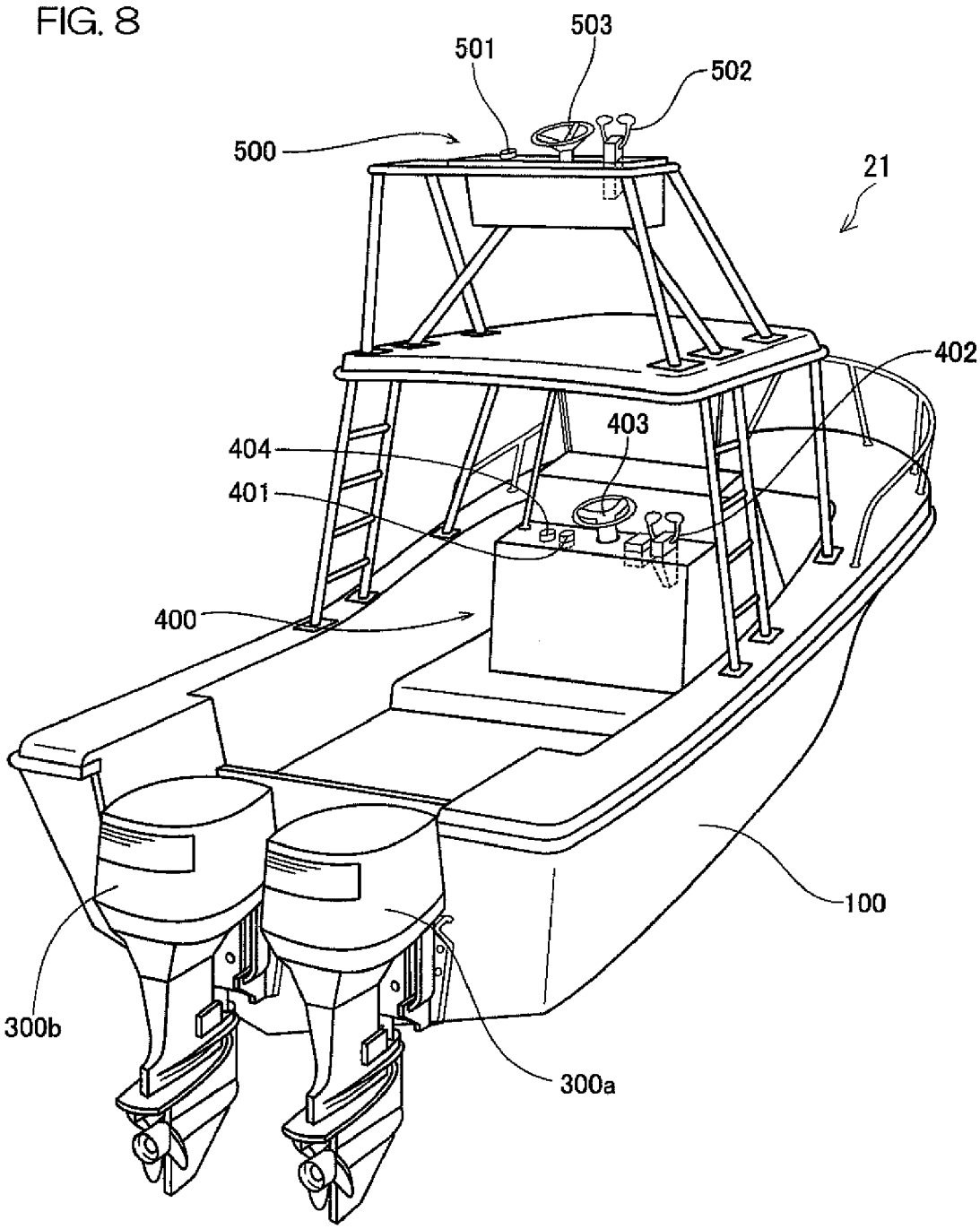
FIG. 8 is a perspective view of a marine vessel including a marine vessel steering apparatus according to a second preferred of the present invention.
Figure 9:
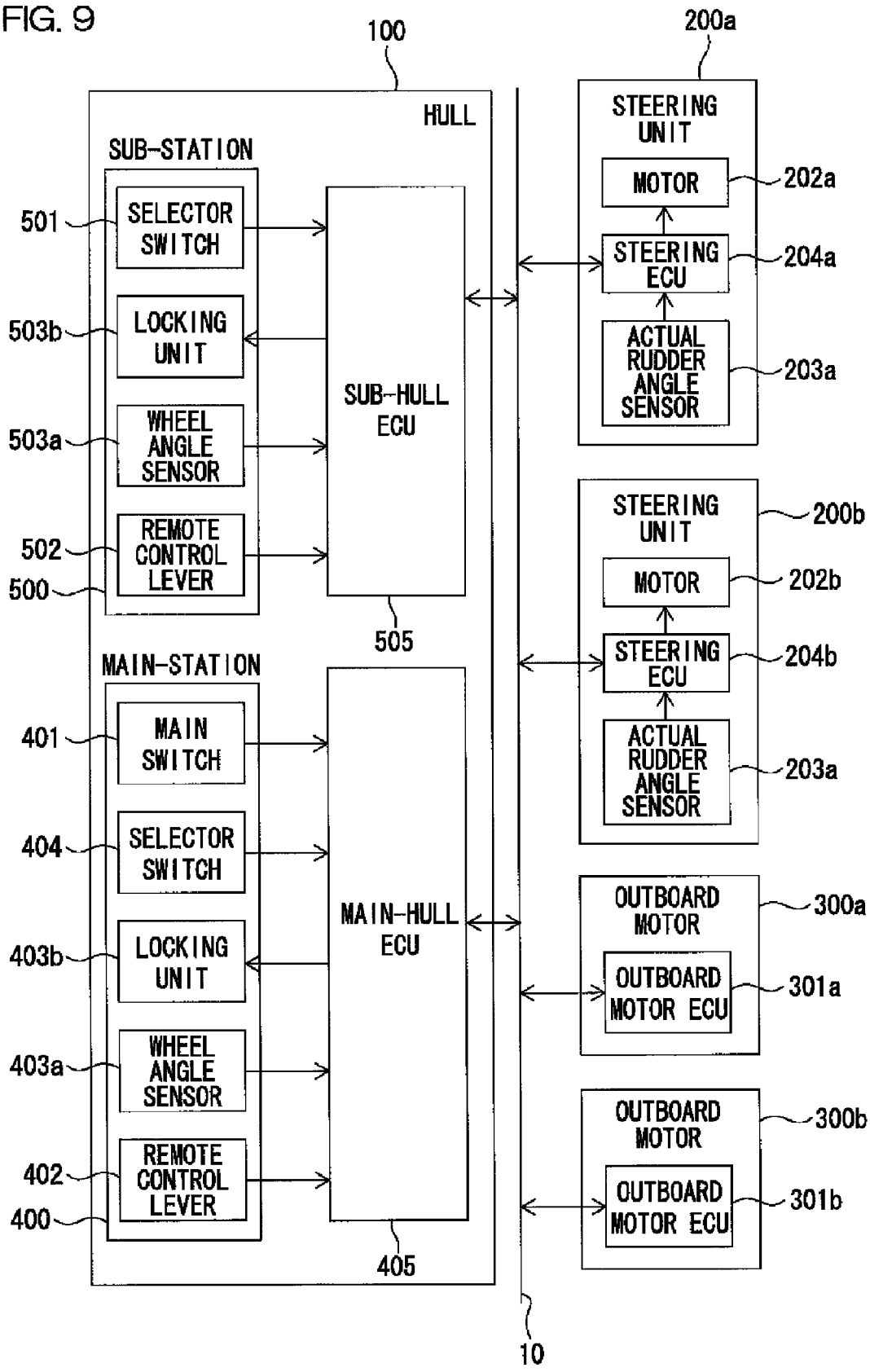
FIG. 9 is a block diagram of the marine vessel steering apparatus according to the second preferred embodiment of the present invention.

FIGS. 8 and 9 show the overall configuration of a marine vessel including a marine vessel propulsion system (marine vessel steering apparatus) according to a second preferred embodiment of the present invention. The present second preferred embodiment describes an example in which two steering wheels are provided for maneuvering of the marine vessel.

The marine vessel 21 according to the second preferred embodiment includes a hull 100, two steering units 200*a* and 200*b*, and two outboard motors 300*a* and 300*b*. The two outboard motors 300*a* and 300*b* are mounted at the stern 101 of the hull 100 via the two respective steering units 200*a* and 200*b*. The hull 100 is equipped with two marine vessel maneuvering stations. That is, the hull 100 has a main-station 400 arranged, for example, at the front part thereof and a sub-station 500 arranged, for example, over the main-station 400.

The main-station 400 has a main switch 401, a remote control lever unit 402, a steering wheel 403, a selector switch 404, and the like arranged thereon. The main switch 401 is arranged to be operated by a marine vessel maneuvering operator to switch between power-on and power-off of a marine vessel propulsion system. The remote control lever unit 402 is arranged to be operated by the operator for direction of throttle opening degree and shift switching. The steering wheel 403 is arranged to be rotationally operated by the operator to change the traveling direction of the hull 100. The selector switch 404 is arranged to be operated by the operator to switch from steering control by the sub-station 500 to steering control by the main-station 400. The steering wheel 403 is provided with a wheel angle sensor 403*a* to detect the amount of change in the rotation angle of the steering wheel 403 and a locking unit 403*b* to be controlled to lock the rotation of the steering wheel 403.

The main switch 401, remote control lever unit 402, steering wheel 403, wheel angle sensor 403*a*, and locking unit 403*b* in the main-station 400 have the same structure, respectively, as the main switch 102, remote control lever unit 103, steering wheel 104, wheel angle sensor 104*a*, and locking unit 104*b* in the above-described first preferred embodiment. Also, the steering wheel 403 is an example of a "first steering wheel" or "second steering wheel" according to one preferred embodiment of the present invention. The wheel angle sensor 403*a* constitutes, together with a main hull ECU 405, an example of a "first wheel angle detecting unit" or "second wheel angle detecting unit" according to one preferred embodiment of the present invention.

The sub-station 500 is provided with a selector switch 501, a remote control lever unit 502, a steering wheel 503, and the like. The selector switch 501 is arranged to be operated by the operator to switch from steering control by the main-station 400 to steering control by the sub-station 500.

In the present second preferred embodiment, the marine vessel propulsion system includes the steering wheels 403 and 503, selector switches 404 and 501, steering units 200*a* and 200*b*, outboard motors 300*a* and 300*b*, and a control unit therefore, and is corresponding to a marine vessel steering apparatus according to one preferred embodiment of the present invention.

The marine vessel propulsion system according to the present second preferred embodiment is arranged such that immediately after the main switch 401 is turned ON, steering control by the main-station 400 is initiated and when the selector switch 501 is turned ON, steering control by the sub-station 500 is initiated. The marine vessel propulsion system is also arranged such that when the selector switch 404 on the main-station 400 is turned ON while steering control by the sub-station 500 is performed, steering control by the main-station 400 is initiated. The selector switches 404 and 501 are an example of a "switching unit" according to one preferred embodiment of the present invention.

The steering wheel 503 is provided with a wheel angle sensor 503*a* for use in detecting the amount of change in the rotation angle of the steering wheel 503 and a locking unit 503*b* to be controlled to lock the rotation of the steering wheel 503.

The remote control lever unit 502, steering wheel 503, wheel angle sensor 503*a*, and locking unit 503*b* in the sub-station 500 have the same structure, respectively, as the remote control lever unit 103, steering wheel 104, wheel angle sensor 104*a*, and locking unit 104*b* in the above-described first preferred embodiment. The steering wheel 503 is an example of a "second steering wheel" or "first steering wheel" according to one preferred embodiment of the present invention. The wheel angle sensor 503*a* constitutes, together with a sub-hull ECU 505, an example of a "second wheel angle detecting unit" or "first wheel angle detecting unit" according to one preferred embodiment of the present invention.

The steering unit 200*a* preferably has the same structure as the steering unit 200 in the above-described first preferred embodiment, including a motor 202*a*, an actual rudder angle sensor 203*a*, and a steering ECU 204*a*. The steering unit 200*b* also preferably has the same structure as the steering unit 200 in the above-described first preferred embodiment, including a motor 202*b*, an actual rudder angle sensor 203*b*, and a steering ECU 204*b*. The motors 202*a* and 202*b* are an example of an "actuator" according to one preferred embodiment of the present invention. The actual rudder angle sensors 203*a* and 203*b* are an example of a "rudder angle sensor" according to one preferred embodiment of the present invention.

The outboard motors 300*a* and 300*b* are mounted side by side so as to align laterally at the stern of the hull 100, and are each arranged to be turned laterally by the steering units 200*a* and 200*b*. The outboard motors 300*a* and 300*b* are an example of a "rudder unit" according to one preferred embodiment of the present invention. The outboard motors 300*a* and 300*b* are each configured similarly as the outboard motor 300 according to the first preferred embodiment, including outboard motor ECUs 301*a* and 301*b*, respectively.

The hull 100 is equipped with a main-hull ECU 405 corresponding to the main-station 400 and a sub-hull ECU 505 corresponding to the sub-station 500. The main-hull ECU 405, sub-hull ECU 505, steering ECUs 204*a* and 204*b*, and outboard motor ECUs 301*a* and 301*b* are coupled to an inboard LAN 10 and arranged to be capable of communicating information with each other via the inboard LAN 10.

It is preferable that only one of the main-hull ECU 405 and the sub-hull ECU 505 performs various controls (shift control, output control, and steering control) in response to the corresponding remote control lever unit 402 or 502 and the corresponding steering wheel 403 or 503. That is, immediately after the main switch 401 is operated and the system is turned ON, the main-station 400 is available and thereby control by the main-hull ECU 405 is accordingly available. When the selector switch 501 on the sub-station 500 is operated, control by the sub-hull ECU 505 is made available. Thereafter, when the selector switch 404 on the main-station 400 is operated, control by the main-hull ECU 405 is made available again.

The main-hull ECU 405 is arranged to acquire an output signal from the wheel angle sensor 403*a* in the main-station 400, and further to acquire detection results (actual rudder angles) of the actual rudder angle sensors 203*a* and 203*b* from the respective steering ECUs 204*a* and 204*b*. Based on the thus acquired information, the main-hull ECU 405 is also arranged, during steering control by the main-station 400, to drive and control the motors 202*a* and 202*b* in the steering units 200*a* and 200*b* and the locking unit 403*b* in the main-station 400. Similarly, the sub-hull ECU 505 is arranged to acquire an output signal from the wheel angle sensor 503*a* in the sub-station 500, and further to acquire detection results (actual rudder angles) of the actual rudder angle sensors 203*a* and 203*b* from the respective steering ECUs 204*a* and 204*b*. Based on the thus acquired information, the sub-hull ECU 505 is also arranged, during steering control by the sub-station 500, to drive and control the motors 202*a* and 202*b* in the steering units 200*a* and 200*b* and the locking unit 503*b* in the sub-station 500.

Signals indicative of the switching among neutral, forward, and reverse driving and of the accelerator operation from the remote control lever unit 402 or 502 are acquired by the corresponding hull ECU 405 or 505. The available hull ECU 405 or 505 is arranged to compute a target shift value (forward, reverse, or neutral) and a target output value (e.g. target engine speed or target throttle opening degree) according to the operation of the remote control lever unit. The available hull ECU 405 or 505 is also arranged to send the target shift value and the target output value to the outboard motor ECUs 301*a* and 301*b* in the respective outboard motors 300*a* and 300*b* via the inboard LAN 10. The outboard motor ECUs 301*a* and 301*b* are each arranged to control the forward-reverse switching mechanism portion based on the target shift value and to control the output of the engine (e.g. engine speed or throttle opening degree) based on the target output value.

When the main switch 401 is operated and the system is turned ON, steering control by the main-station 400 (steering control corresponding to the steering wheel 403) is started. The operation in this case is the same as in the first preferred embodiment.

Thereafter, when the selector switch 501 on the sub-station 500 is operated, steering control by the sub-station 500 (steering control corresponding to the steering wheel 503) is started. Thereafter, when the selector switch 401 on the main-station 400 is operated, steering control by the main-station 400 is started again. These operations associated with the switching between the marine vessel maneuvering stations will be described below.

During steering control by the main-station 400, when the main-hull ECU 405 is stopped temporarily and then restarted, the steering control by the main-station 400 is also restarted. The operation in this case is the same as when the system is powered on. Similarly, during steering control by the sub-station 500, when the sub-hull ECU 505 is stopped temporarily and then restarted, the steering control by the sub-station 500 is also restarted. The operation in this case is the same as the following operation when the control is switched from the main-station 400 to the sub-station 500.

In the present second preferred embodiment, when the selector switch 501 on the sub-station 500 is pressed and steering control by the sub-station 500 is started, the sub-hull ECU 505 sets the actual rudder angles of the outboard motors 300*a* and 300*b* at the start point as initial target rudder angles for the respective outboard motors 300*a* and 300*b*. This setting process is performed every time the steering control by the sub-station 500 is started. On the other hand, the sub-hull ECU 505 acquires from the wheel angle sensor 503*a* the amount of change in the rotation angle of the steering wheel 503 on the sub-station 500 after the steering control by the sub-station 500 is started. The sub-hull ECU 505 further obtains an amount of change in the target rudder angle corresponding to the acquired amount of change in the rotation angle. The amount of change in the target rudder angle may be obtained using a map, or may be obtained via an operation using a transmission ratio and the like, as is the case in the first preferred embodiment. The amount of change in the target rudder angle may be common to the two outboard motors 300*a* and 300*b* or may be obtained differently for each of the two outboard motors 300*a* and 300*b*. The sub-hull ECU 505 adds the thus obtained amount of change in the target rudder angle to the initial target rudder angles of the respective outboard motors 300*a* and 300*b* to compute a target rudder angle of each of the outboard motors 300*a* and 300*b*. The sub-hull ECU 505 then gives the target rudder angles to the respective steering ECUs 204*a* and 204*b* via the inboard LAN 10. The steering ECUs 204*a* and 204*b* control the respective motors 202*a* and 202*b* such that the actual rudder angles detected by the respective actual rudder angle sensors 203*a* and 203*b* are made equal to the corresponding target rudder angles.

As described heretofore, the sub-hull ECU 505 accepts the relationship between the rotational position of the steering wheel 503 on the sub-station 500 (wheel angle) and the actual rudder angles of the outboard motors 300*a* and 300*b* at the start of steering control by the sub-station 500 as an initial state and performs the subsequent steering control. It is therefore possible to perform the steering control without suffering from a phase shifting between the steering wheel 503 and the outboard motors 300*a* and 300*b* immediately after the switching between the marine vessel maneuvering stations. It is also possible to perform the steering control without suffering from a phase shifting in wheel angle between the main-station 400 and the sub-station 500 immediately after the switching between the marine vessel maneuvering stations. That is, because the wheel angle is merely a relative value from the start of steering control in each station in each of the main-station 400 and the sub-station 500, the concept of "phase shifting" cannot occur in the present preferred embodiment.

During steering control by the sub-station 500, when the selector switch 404 on the main-station 400 is pressed, the steering control by the sub-station 500 is switched to steering control by the main-station 400. In this case, the same control is performed as the case of switching from the main-station 400 to the sub-station 500. That is, when the selector switch 404 on the main-station 400 is pressed and steering control by the main-station 400 is started, the main-hull ECU 405 sets the actual rudder angles of the outboard motors 300*a* and 300*b* at the start point as initial target rudder angles for the respective outboard motors 300*a* and 300*b*. This setting process is performed every time the steering control by the main-station 400 is started. On the other hand, the main-hull ECU 405 acquires from the wheel angle sensor 403*a* the amount of change in the rotation angle of the steering wheel 403 on the main-station 400 after the steering control by the main-station 400 is started. The main-hull ECU 405 further obtains an amount of change in the target rudder angle corresponding to the acquired amount of change in the rotation angle. The amount of change in the target rudder angle may be obtained using a map, or may be obtained through an operation using a transmission ratio and the like, as is the case in the first preferred embodiment. The amount of change in the target rudder angle may be common to the two outboard motors 300*a* and 300*b* or may be obtained differently for each of the two outboard motors 300*a* and 300*b*, as is the case with the sub-station. The main-hull ECU 405 adds the thus obtained amount of change in the target rudder angle to the initial target rudder angles of the respective outboard motors 300*a* and 300*b* to compute a target rudder angle of each of the outboard motors 300*a* and 300*b*. The main-hull ECU 405 then gives the target rudder angles to the respective steering ECUs 204*a* and 204*b* via the inboard LAN 10. The steering ECUs 204*a* and 204*b* control the respective motors 202*a* and 202*b* such that the actual rudder angles detected by the respective actual rudder angle sensors 203*a* and 203*b* are made equal to the corresponding target rudder angles.

As described heretofore, the main-hull ECU 405 accepts the relationship between the rotational position of the steering wheel 403 on the main-station 400 (wheel angle) and the actual rudder angles of the outboard motors 300*a* and 300*b* at the start of steering control by the main-station 400 as an initial state and performs the subsequent steering control. It is therefore possible to perform the steering control without suffering from a phase shifting between the steering wheel 403 and the outboard motors 300*a* and 300*b* immediately after the switching between the marine vessel maneuvering stations. It is also possible to perform the steering control without suffering from a phase shifting in wheel angle between the main-station 400 and the sub-station 500 immediately after the switching between the marine vessel maneuvering stations.

Figure 10A:
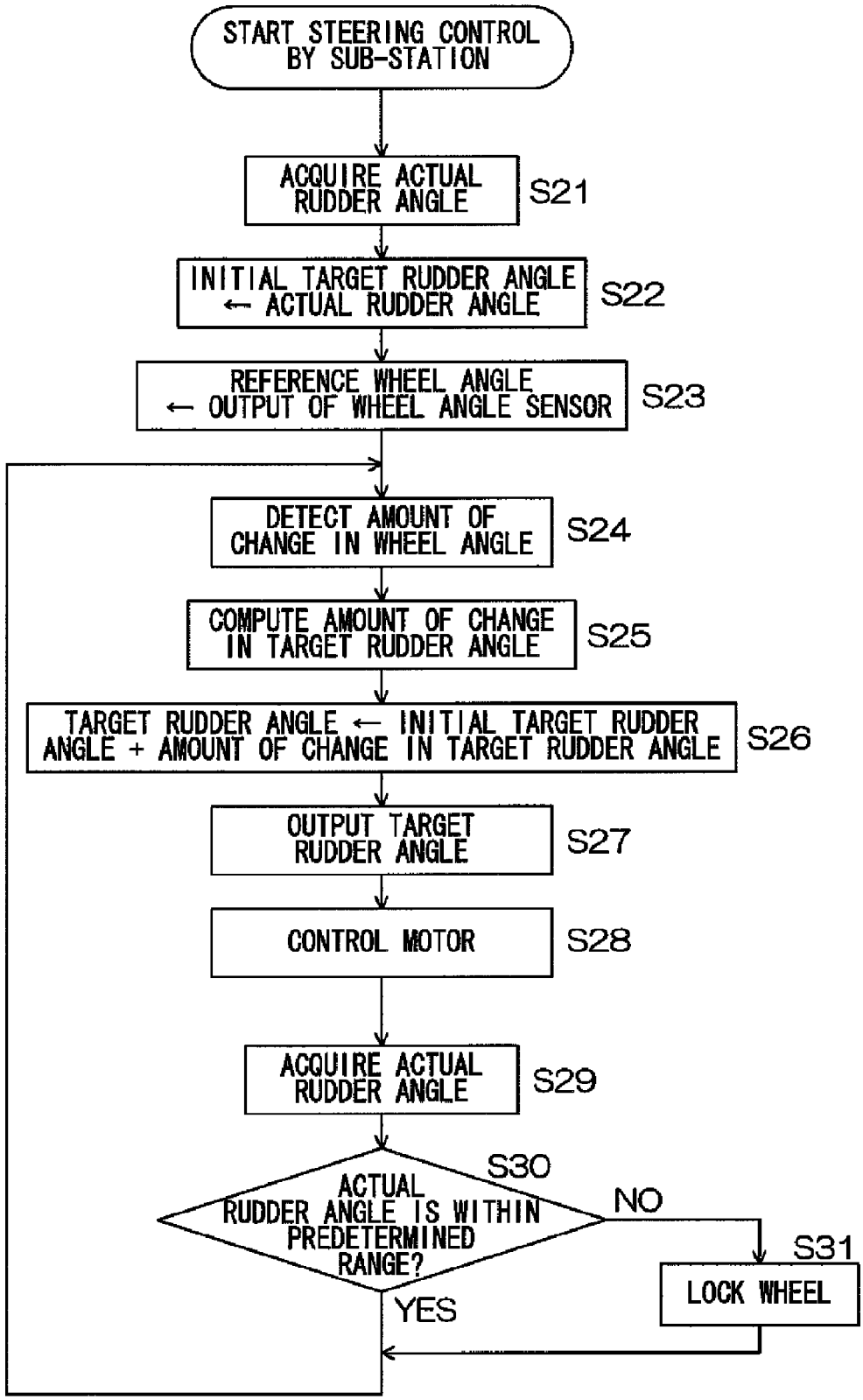
FIGS. 10A and 10B are flow charts illustrating the steering control of the marine vessel steering apparatus according to the second preferred embodiment of the present invention.
Figure 10B:
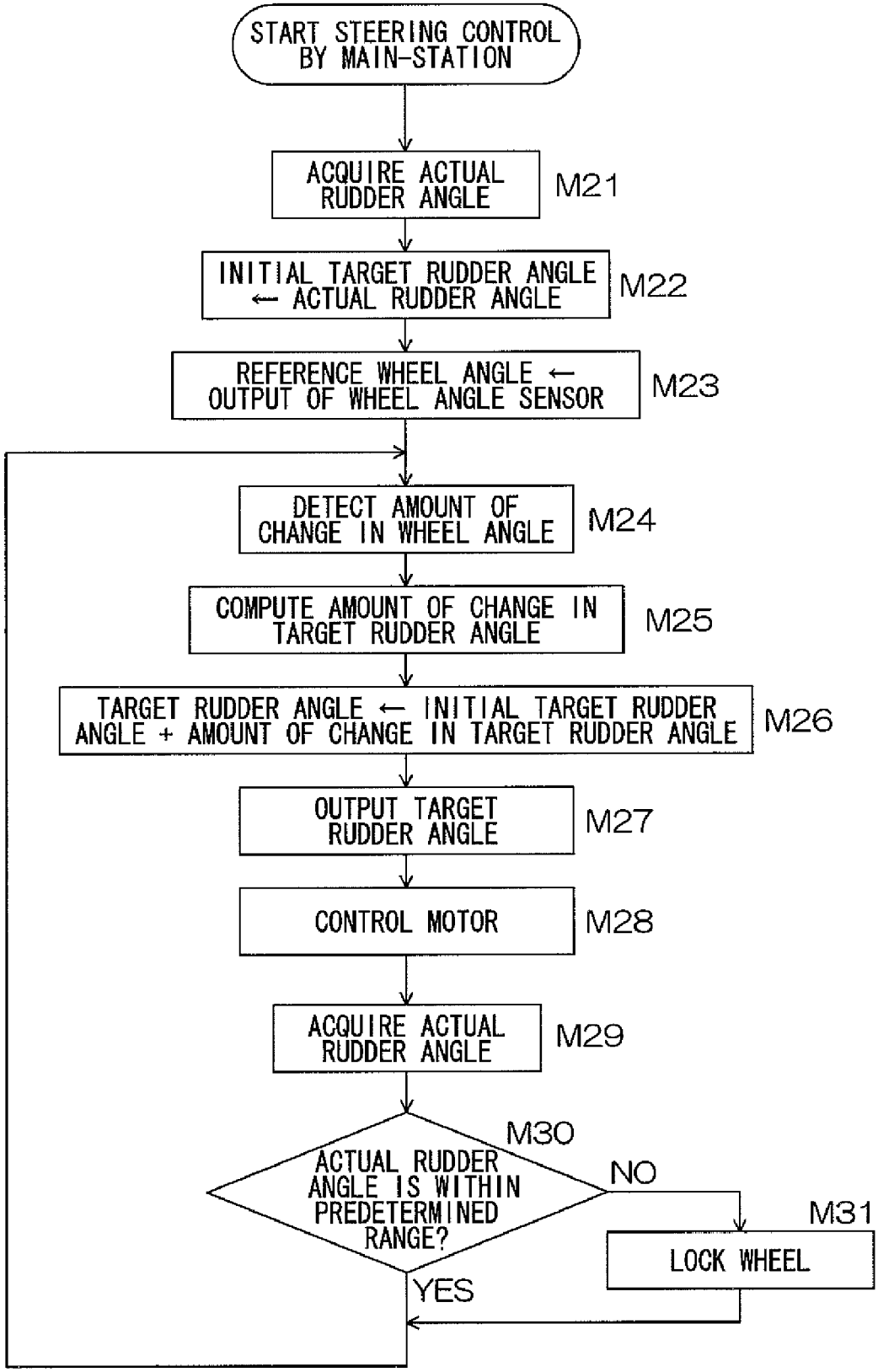
Figure 11:
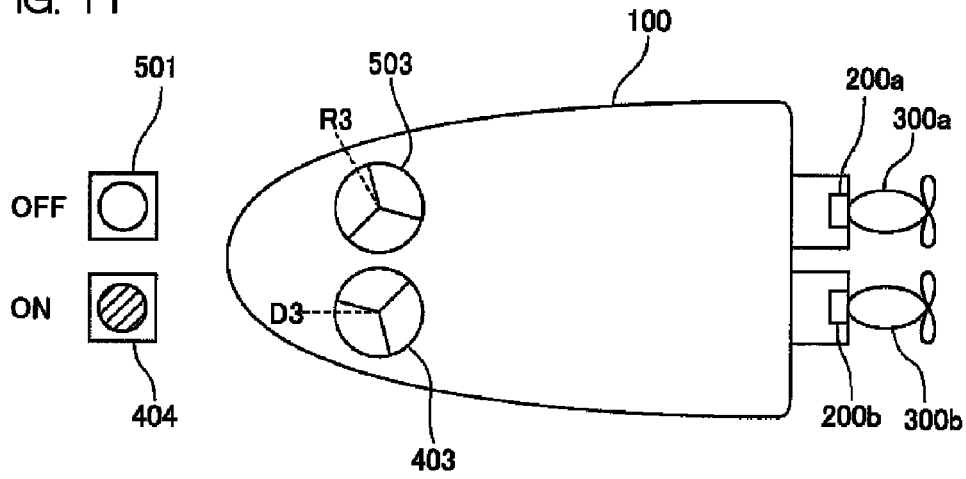
FIGS. 11, 12, and 13 are schematic plan views illustrating the steering control of the marine vessel steering apparatus according to the second preferred embodiment of the present invention.
Figure 12:
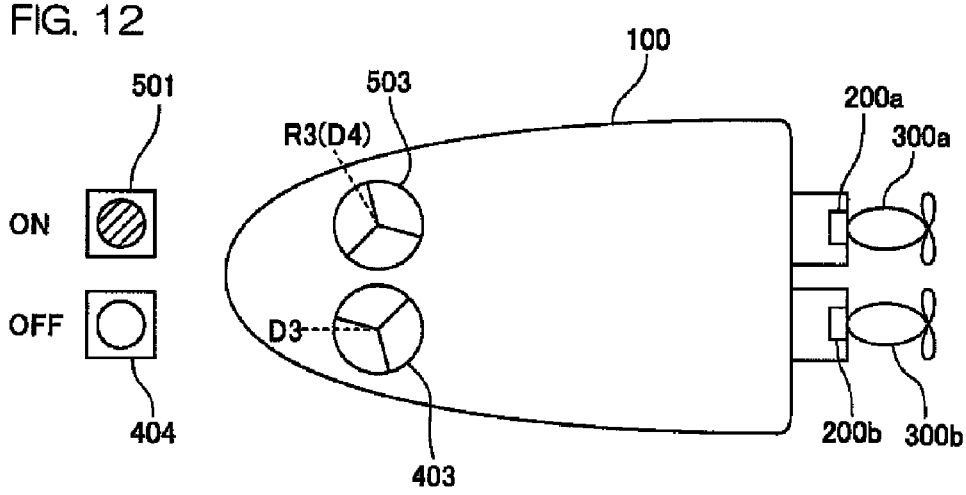
Figure 13:
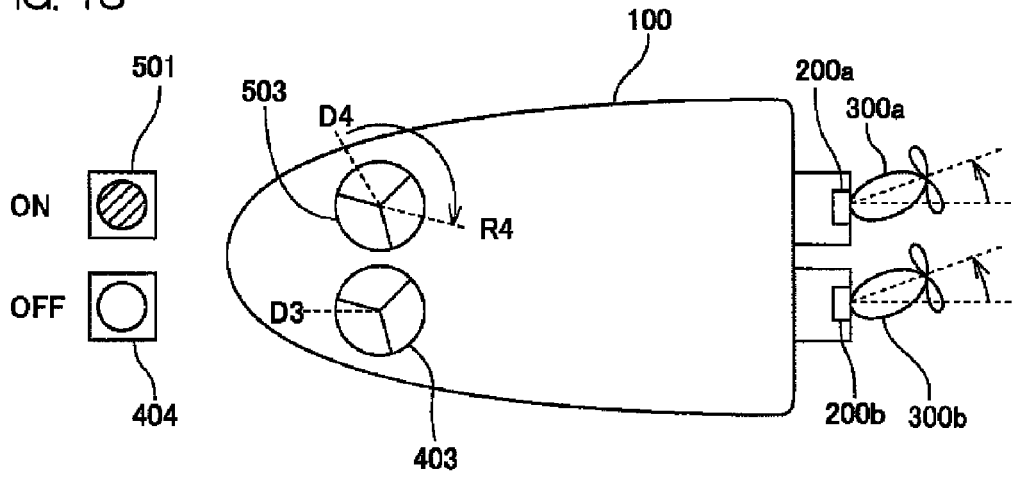

FIGS. 10A and 10B are flow charts illustrating the steering control of the marine vessel propulsion system (marine vessel steering apparatus) according to the second preferred embodiment of the present invention. FIGS. 11 to 13 are schematic views for illustrating the control according to the flow chart shown in FIG. 10A.

As shown in FIG. 11, when the selector switch 501 on the sub-station 500 is OFF (and the selector switch 404 on the main-station 400 is ON), the main-station 400 is available. That is, steering control by the main-station 400 is performed and the outboard motors 300*a* and 300*b* are turned in response to the operation of the steering wheel 403. On the other hand, the steering wheel 503 on the sub-station 500, by which no steering control is performed, is rotatable freely. Therefore, the rotation angle (phase) of the steering wheel 503 is changed independently of the actual rudder angles (phase) of the outboard motors 300*a* and 300*b*. In FIG. 11, the actual rudder angle of the outboard motors 300*a* and 300*b* is zero degrees (straight traveling) and the rotation angle of the steering wheel 403 on the main-station 400 is also at the position of straight traveling. On the other hand, the rotation angle of the steering wheel 503 on the sub-station 500 is at a turning position (indicated by R3) shifted from the position of straight traveling (indicated by D3) of the main-station 400. However, this is on the assumption that the reference position of the steering wheel 503 and the reference position of the steering wheel 403 are identical.

As shown in FIG. 12, when the selector switch 501 on the sub-station 500 is turned ON, the steering control by the main-station 400 is switched to steering control by the sub-station 500. In this case, the sub-hull ECU 505 acquires actual rudder angles detected by the actual rudder angle sensors 203*a* and 203*b* from the respective steering ECUs 204*a* and 204*b* (Step S21 in FIG. 10A). The sub-hull ECU 505 then sets the acquired actual rudder angles as initial target rudder angles for the respective outboard motors 300*a* and 300*b* (Step S22). Further, the sub-hull ECU 505 stores an output from the wheel angle sensor 503*a* at the switching between the steering controls (at the start of the steering control by the sub-station 500) as a reference wheel angle (zero-degree position) (Step S23).

Subsequently, the sub-hull ECU 505 detects the amount of change in the wheel angle with respect to the reference wheel angle (indicated by D4) based on a signal from the wheel angle sensor 503*a* (Step S24). The sub-hull ECU 505 also obtains an amount of change in the target rudder angle corresponding to the amount of change in the wheel angle (Step S25). The sub-hull ECU 505 further adds the amount of change in the target rudder angle to the initial target rudder angles to obtain target rudder angles for the respective outboard motors 300*a* and 300*b* (Step S26). The sub-hull ECU 505 then gives the target rudder angles to the respective steering ECUs 204*a* and 204*b* via the inboard LAN 10 (Step S27). The steering ECUs 204*a* and 204*b* control the respective motors 202*a* and 202*b* such that the actual rudder angles are made equal to the respective target rudder angles (Step S28). This causes the outboard motors 300*a* and 300*b* to be turned by an angle corresponding to the amount of change in the wheel angle with respect to the reference wheel angle (indicated by D4). In FIG. 13, the outboard motors 300*a* and 300*b* are turned from the straight traveling to a turning position in response to the steering wheel 503 being rotated from the reference wheel angle D4 to a turning position R4.

The sub-hull ECU 505 further acquires the actual rudder angles of the outboard motors 300*a* and 300*b* from the respective steering ECUs 204*a* and 204*b* (Step S29). The sub-hull ECU 505 then determines whether or not the actual rudder angles of the outboard motors 300*a* and 300*b* are each within a preset predetermined range (the turn limits of the outboard motors 300*a* and 300*b*) (Step S30). If the actual rudder angles of the outboard motors 300*a* and 300*b* are both within the predetermined range (approximately ±30 degrees, for example), the processing of the sub-hull ECU 505 returns to Step S24. If at least one of the actual rudder angles of the outboard motors 300*a* and 300*b* is not within the corresponding predetermined range (approximately ±30 degrees, for example), the sub-hull ECU 505 drives the locking unit 503*b* to lock the steering wheel 503 so as not to be further rotated in the turning direction (Step S31). The processing of the sub-hull ECU 505 then returns to Step S24. During the steering control by the sub-station 500, Steps S24 to S31 are repeated at predetermined time intervals.

As shown in FIG. 10B, the same operation is also performed at the start of steering control by the main-station 400. Steering control by the main-station 400 will be started when the system is powered on or when the control is switched from the sub-station 500 to the main-station 400. Specifically, when steering control by the main-station 400 is started, the main-hull ECU 405 acquires actual rudder angles detected by the actual rudder angle sensors 203*a* and 203*b* from the respective steering ECUs 204*a* and 204*b* (Step M21 in FIG. 10B). The main-hull ECU 405 then sets the acquired actual rudder angles as initial target rudder angles for the respective outboard motors 300*a* and 300*b* (Step M22). Further, the main-hull ECU 405 stores an output from the wheel angle sensor 403*a* at the start of the steering control by the main-station 500 as a reference wheel angle (zero-degree position) (Step M23).

Subsequently, the main-hull ECU 405 detects the amount of change in the wheel angle with respect to the reference wheel angle based on a signal from the wheel angle sensor 403*a* (Step M24). The main-hull ECU 405 also obtains an amount of change in the target rudder angle corresponding to the amount of change in the wheel angle (Step M25). The main-hull ECU 405 further adds the amount of change in the target rudder angle to the initial target rudder angles to obtain target rudder angles for the respective outboard motors 300*a* and 300*b* (Step M26). The main-hull ECU 405 then gives the target rudder angles to the respective steering ECUs 204*a* and 204*b* via the inboard LAN 10 (Step M27). The steering ECUs 204*a* and 204*b* control the respective motors 202*a* and 202*b* such that the actual rudder angles are made equal to the respective target rudder angles (Step M28). This causes the outboard motors 300*a* and 300*b* to be turned by an angle corresponding to the amount of change in the wheel angle with respect to the reference wheel angle.

The main-hull ECU 405 further acquires the actual rudder angles of the outboard motors 300*a* and 300*b* from the respective steering ECUs 204*a* and 204*b* (Step M29). The main-hull ECU 405 then determines whether or not the actual rudder angles of the outboard motors 300*a* and 300*b* are each within a preset predetermined range (the turn limits of the outboard motors 300*a* and 300*b*) (Step M30). If the actual rudder angles of the outboard motors 300*a* and 300*b* are both within the predetermined range (approximately ±30 degrees, for example), the processing of the main-hull ECU 405 returns to Step M24. If at least one of the actual rudder angles of the outboard motors 300*a* and 300*b* is not within the corresponding predetermined range (approximately ±30 degrees, for example), the main-hull ECU 405 drives the locking unit 403*b* to lock the steering wheel 403 so as not to be further rotated in the turning direction (Step M31). The processing of the main-hull ECU 405 then returns to Step M24. During the steering control by the main-station 400, Steps M24 to M31 are repeated at predetermined time intervals.

In the present second preferred embodiment, as described above, if the steering control between the main-station 400 and the sub-station 500 is switched, the relationship between the wheel angle (the rotation angle of the steering wheel 403 or 503) and the rudder angle of the outboard motor (outboard motors 300*a* and 300*b*) at the switching is accepted as it is as an initial state. This can prevent the motor (motor 202*a* in the steering unit 200*a* and motor 202*b* in the steering unit 200*b*) from being driven at the switching between the steering controls. This can accordingly provide the operator and other crew members or passengers with an improved, more comfortable movement of the outboard motor. Also, since the motor in the steering unit is controlled to change the rudder angle of the outboard motor in accordance with the amount of change with respect to the reference wheel angle (initial wheel angle at the switching) of the switched steering wheel, the rudder angle of the outboard motor is changed in accordance with the rotation of the steering wheel on the switched marine vessel maneuvering station by the operator after the switching between the marine vessel maneuvering stations. Therefore, the operator can steer the rudder to his/her intention. Further, the operator can initiate the steering operation on the switched marine vessel maneuvering station.

Other effects and advantages achieved by the second preferred embodiment are the same as those of the above-described first preferred embodiment.

Third Preferred Embodiment

Figure 14:
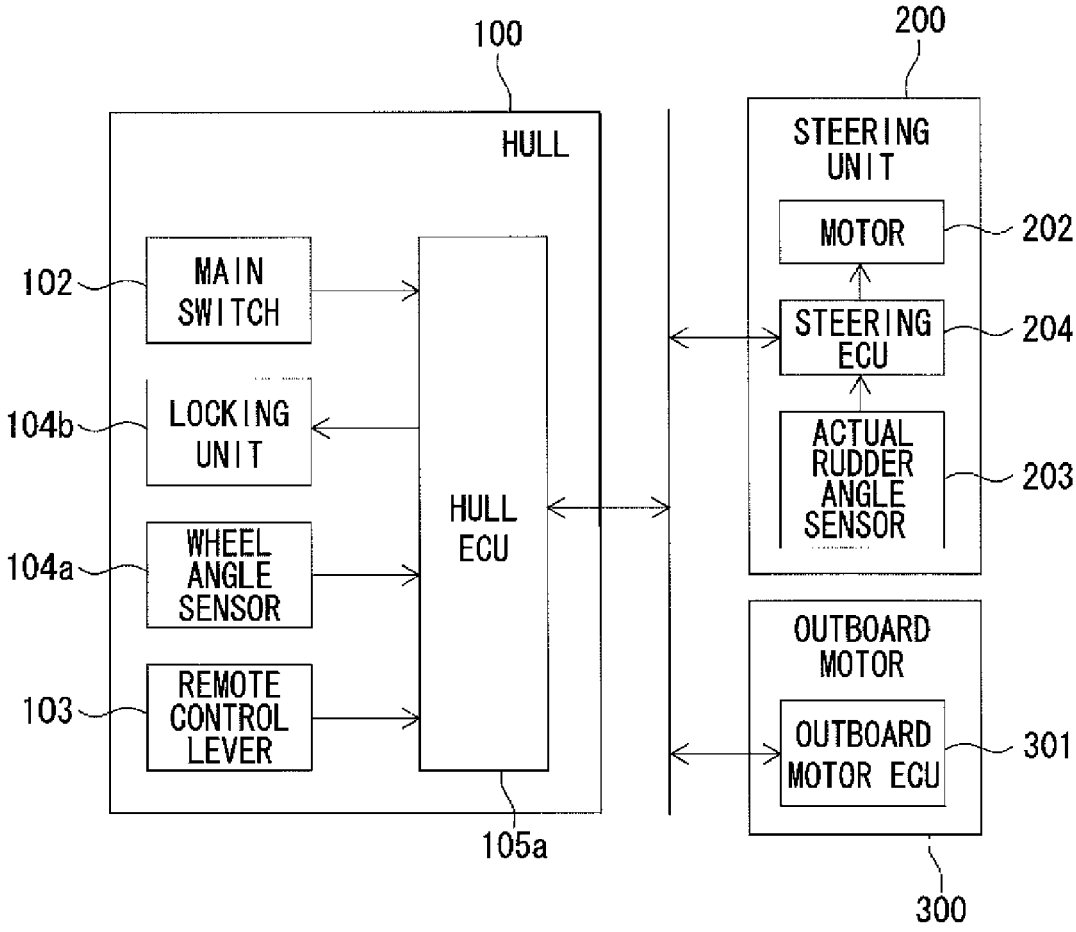
FIG. 14 is a block diagram of a marine vessel steering apparatus according to a third preferred embodiment of the present invention.

FIG. 14 is a block diagram of a marine vessel propulsion system (marine vessel steering apparatus) according to a third preferred embodiment of the present invention. The present third preferred embodiment describes an example in which the outboard motor is turned based on the rotation speed of the steering wheel 104. The rotation speed is an example of the "change in the rotation angle," being the amount of change in the rotation angle during a certain period of time. Therefore, the rotation speed is included in the amount of change in the rotation angle in a broad sense. The amount of change in the rotation angle, in a narrow sense, is the rotation angle change with an arbitrary period of time elapses after a reference wheel angle is set, for example.

As shown in FIG. 14, the marine vessel propulsion system according to the third preferred embodiment includes a hull ECU 105*a*. The configurations other than the hull ECU 105*a* are preferably the same as those in the marine vessel propulsion system according to the above-described first preferred embodiment. In the present third preferred embodiment, the hull ECU 105*a* is arranged to acquire the rotation speed of the steering wheel 104 at predetermined time intervals (e.g., about every 5 seconds) (i.e., the amount of change in the wheel angle within a predetermined time period) based on a signal from the wheel angle sensor 104*a*. The hull ECU 105*a* is also arranged to drive the motor 202 in the steering unit 200 based on the rotation speed of the steering wheel 104.

In the hull ECU 105*a*, an amount of change in the target rudder angle by which the outboard motor 300 is to be turned is preset as correspondence values corresponding to each value of the rotation speed of the steering wheel 104. These correspondence values may be mapped to define the correspondence relationships, for example. This map may be modified depending on running situations of the marine vessel (e.g., marine vessel velocity, wheel operation speed, and failure detection states). Alternatively, a specific operation based on running situations of the marine vessel may be implemented for the rotation speed of the steering wheel 104 to set an angle (amount of change in the target rudder angle)

by which the outboard motor 300 is to be turned. For example, the amount of change in the target rudder angle may be obtained by multiplying the amount of change in the rotation angle of the steering wheel 104 by a predetermined gain. In this case, the gain may be modified depending on running situations of the marine vessel.

Figure 15:
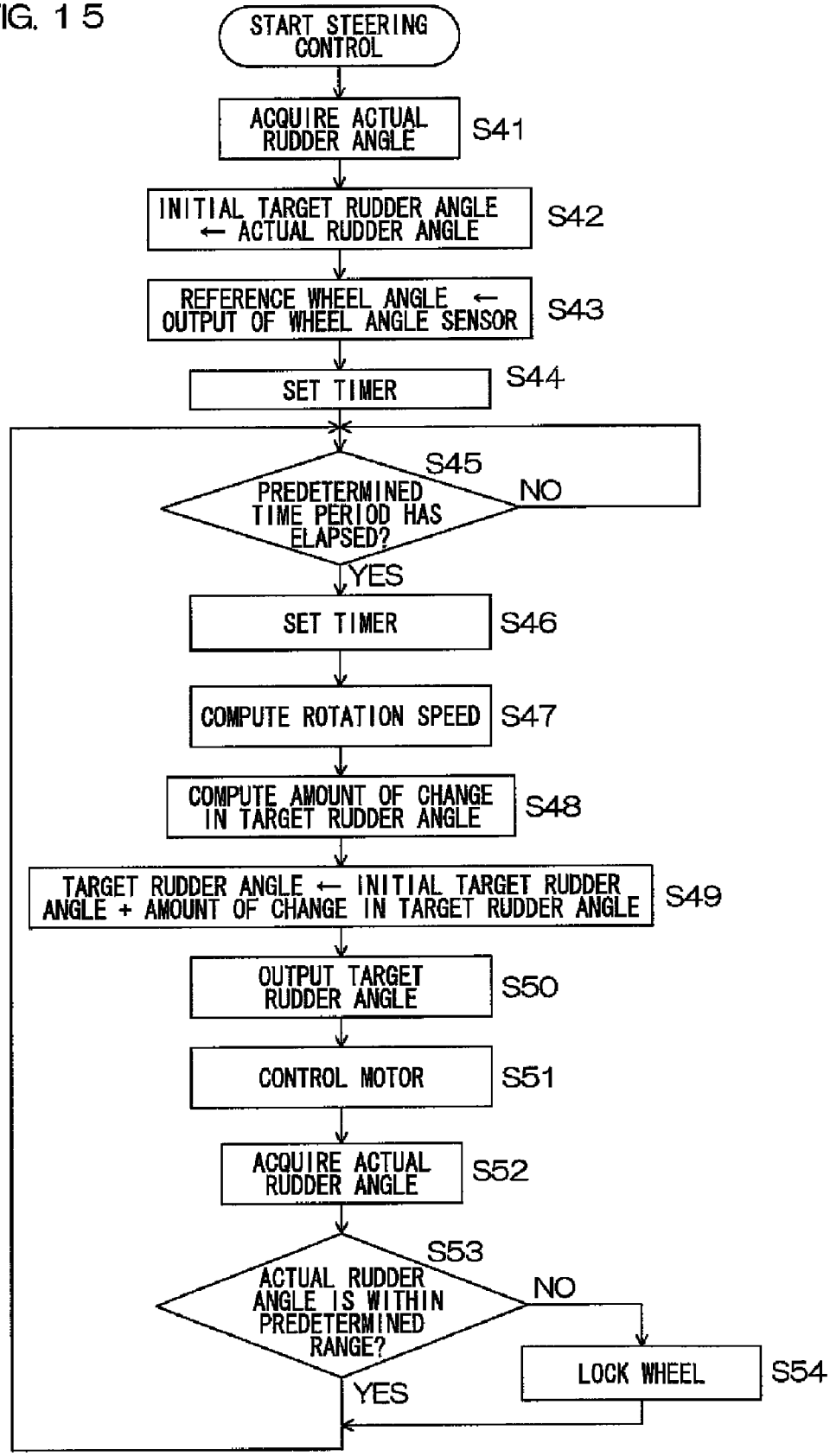
FIG. 15 is a flow chart illustrating the steering control of the marine vessel steering apparatus according to the third preferred embodiment of the present invention.

FIG. 15 is a flow chart illustrating the steering control of the marine vessel propulsion system (marine vessel steering apparatus) according to the third preferred embodiment of the present invention.

First, Steps S41 to S43 undergo the same processing as Steps S1 to S3 in the above-described first preferred embodiment (see FIG. 4). Next, the hull ECU 105*a* sets a timer (Step S44). This set time is a time duration for calculation of the rotation speed of the steering wheel 104 (e.g., about 5 msec).

The hull ECU 105*a* then determines whether or not the predetermined time period (set on the timer) has elapsed (Step S45). If the predetermined time period has not yet elapsed, this determination is repeated. If the predetermined time period has elapsed, the hull ECU 105*a* sets a timer again (Step S46). The hull ECU 105*a* then computes the amount of change in the wheel angle within the predetermined time period (rotation speed of the steering wheel 104) based on a signal from the wheel angle sensor 104*a* (Step S47). Subsequently, the hull ECU 105*a* obtains an amount of change in the target rudder angle corresponding to the rotation speed (Step S48). Further, the hull ECU 105*a* adds the amount of change in the target rudder angle to the initial target rudder angle to obtain a target rudder angle (Step S49). The hull ECU 105 then gives the target rudder angle to the steering ECU 204 via the inboard LAN 10 (Step S50). The steering ECU 204 controls the motor 202 such that the actual rudder angle is made equal to the target rudder angle (Step S51). This causes the outboard motor 300 to be turned by an angle corresponding to the rotation speed of the steering wheel 104.

Thereafter, Steps S52 to S54 undergo preferably the same processing as Steps S9 to S11 in the above-described first preferred embodiment (see FIG. 4). Steps S45 to S54 are then repeated at predetermined time intervals.

Effects and advantages achieved by the third preferred embodiment are the same as those of the above-described first preferred embodiment.

Fourth Preferred Embodiment

Figure 16:
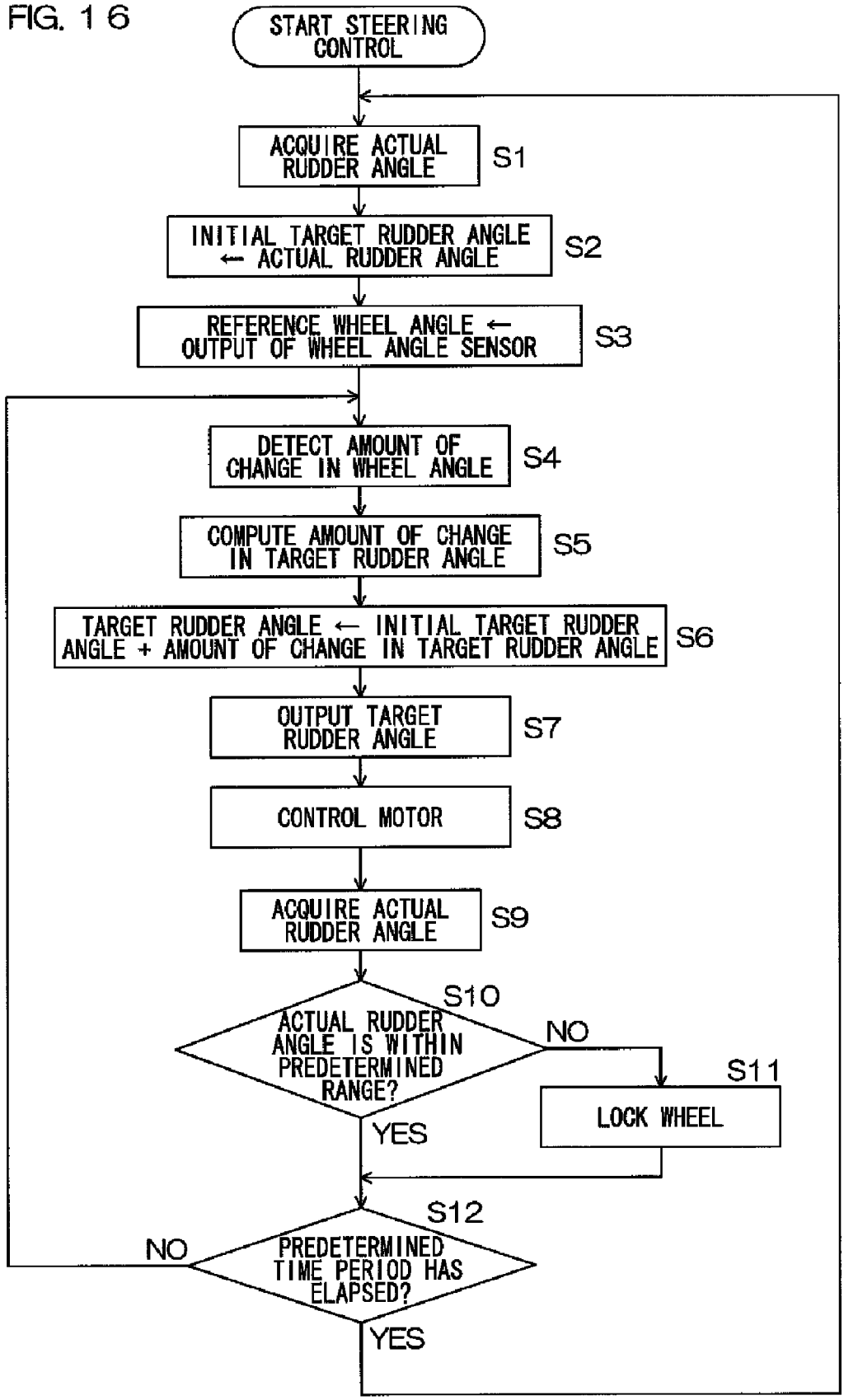
FIG. 16 is a flow chart illustrating the operation of a marine vessel steering apparatus according to a fourth preferred embodiment of the present invention.

FIG. 16 is a flow chart illustrating the operation of a marine vessel propulsion system (marine vessel steering apparatus) according to a fourth preferred embodiment of the present invention. The following descriptions of the present fourth preferred embodiment also refer to FIGS. 1 to 3 used to illustrate the above-described first preferred embodiment. Also, in FIG. 16, steps corresponding to those in FIG. 4 are designated by the same reference numerals.

In the present fourth preferred embodiment, after processing of Steps S10 and S11, the hull ECU 105 determines whether or not a predetermined time period (e.g., about 5 seconds) has elapsed (Step S12). If the predetermined time period has not yet elapsed, the processing returns to Step S4. If the predetermined time period has elapsed, the processing returns to Step S1. This is an initializing process in which the actual rudder angle of the outboard motor 30 is set as an initial target rudder angle. The initial target rudder angle is thus reset as an actual rudder angle at predetermined time intervals. It is therefore possible to hold a state where the actual rudder angle is matched with the target rudder angle.

For example, when the marine vessel maneuvering operator operates the steering wheel 104 quickly, the target rudder angle changes rapidly and a delay in the actual rudder angle following the target rudder angle may occur. In this case, the actual rudder angle of the outboard motor 300 has a phase lag with respect to the rotation angle of the steering wheel 104. Hence, in the present preferred embodiment, the initial target rudder angle is reset at predetermined time intervals. This can eliminate such a phase lag and provide a more comfortable experience for the operator and passengers.

Other Preferred Embodiments

The above-disclosed preferred embodiments are to be considered in all aspects only as illustrative and not restrictive. The scope of the present invention is not defined by the above-described preferred embodiments, but rather by the claims appended hereto. Further, the present invention includes all the modifications within the meaning and scope equivalent to those defined by the appended claims.

For example, although the second preferred embodiment above describes the case where two marine vessel maneuvering stations (main-station 400 and sub-station 500) are preferably provided, the present invention is not restricted thereto, and three or more marine vessel maneuvering stations may be provided, for example.

Although the first preferred embodiment above describes the case where the rudder angle of the outboard motor 300 is preferably at the position of straight traveling at the start of steering control, the present invention is not restricted thereto. That is, the rudder angle of the outboard motor 300 may be a turning state turned from that of straight traveling at the start of steering control. Also, in this case, the turning position (actual rudder angle) of the outboard motor 300 is preferably set as an initial target rudder angle. That is, the rotational position of the steering wheel 104 at the start of steering control is set as a reference wheel angle (initial wheel angle), and the actual rudder angle (turning position) detected by the actual rudder angle sensor 203 is set as an initial target rudder angle. Then, an amount of change in the target rudder angle is obtained corresponding to the amount of rotation from the reference wheel angle detected by the wheel angle sensor 104*a*. The amount of change in the target rudder angle is added to the initial target rudder angle to obtain a target rudder angle. This also applies to the case of switching between the marine vessel maneuvering stations in the above-described second preferred embodiment.

Also, although the first preferred embodiment above describes the case where only one outboard motor 300 is preferably used, the present invention is not restricted thereto, and may be applied to marine vessels equipped with two or more outboard motors. Also, if there are two or more outboard motors and when the rudder angles of the outboard motors are different from each other, the rudder angles of the outboard motors may be made equal to each other before starting steering control. Further, if the rudder angles of two outboard motors are different from each other, the rudder angles may be controlled such that the two outboard motors are arranged in a truncated chevron shape in plan view (two outboard motors are arranged to be closed from the front end (nearer the hull) toward the rear end (nearer the propeller) in plan view) before starting steering control.

Also, although the preferred embodiments above describe the case where the rotation of the steering wheel 104 is preferably locked by the locking unit 104*b* that uses magnetic fluid 32 to add friction to the rotation of the wheel shaft 30, the present invention is not restricted thereto. For example, a locking mechanism (e.g. reaction force motor) may be that is used arranged to add torque to the wheel shaft 30 in the direction opposite to that in which the steering wheel 104 is operated. Alternatively, another locking mechanism may be used that is arranged to lock the steering wheel when needed by switching the engagement between a clutch disk on the steering wheel and a clutch disk fixed to the housing or the like using an actuator.

Also, although the above-described preferred embodiments exemplify the steering unit in which the outboard motor is turned by a driving force from the motor, the present invention is not restricted thereto. For example, a hydraulic system may be used instead of the motor as an actuator for turning the rudder unit.

Also, although the above-described preferred embodiments exemplify the marine vessel in which the outboard motor is preferably used as a rudder unit, the present invention may also be applied to other types of marine vessels, such as equipped with an inboard-outboard motor (stern drive, inboard motor/outboard drive). The phrase "inboard-outboard motor" means that a motor is arranged inside the vessel, while a propulsive force generating member (propeller) and a drive unit including a rudder member is arranged outside the vessel. In this case, the drive unit corresponds to a rudder unit arranged to be turned laterally with respect to the hull.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The present application corresponds to Japanese Patent Application No. 2008-289907 filed in the Japan Patent Office on Nov. 12, 2008, and the entire disclosure of the application is incorporated herein by reference.

What is claimed is:

1. A marine vessel steering apparatus comprising:

a rudder unit arranged to be mounted pivotally on a hull;

an actuator arranged to turn the rudder unit;

a rudder angle sensor arranged to detect a rudder angle of the rudder unit;

a steering wheel arranged to be operated by an operator to steer the rudder unit;

a wheel angle detecting unit arranged to detect an amount of change in a rotation angle of the steering wheel; and a control unit arranged to perform a steering control operation by which the control unit controls the actuator based on values detected by the rudder angle sensor and the wheel angle detecting unit; wherein the control unit is arranged to set the rudder angle of the rudder unit detected by the rudder angle sensor at a start of the steering control operation corresponding to the steering wheel as an initial target rudder angle and compute a target rudder angle based on the initial target rudder angle and the change in the rotation angle of the steering wheel, and to control the actuator to change the rudder angle of the rudder unit in accordance with the target rudder angle; and the start of the steering control operation includes a time period when the marine vessel steering apparatus is powered on and when the control unit is stopped temporarily and then restarted.

2. The marine vessel steering apparatus according to claim 1, wherein the rudder unit is arranged to hold the rudder angle thereof when the steering control operation is in a stopped state, and the steering wheel is arranged to be rotatable independently of the rudder angle of the rudder unit when the steering control operation corresponding to the steering wheel is in a stopped state.

3. The marine vessel steering apparatus according to claim 1, further comprising a locking mechanism arranged to lock the rotation of the steering wheel, wherein the control unit is arranged, when the rudder angle of the rudder unit detected by the rudder angle sensor is out of a preset angular range, to control the locking mechanism to lock the steering wheel regardless of a rotational position of the steering wheel.

4. The marine vessel steering apparatus according to claim 1, wherein the control unit is arranged, after the start of the steering control operation corresponding to the steering wheel, to reset the rudder angle of the rudder unit detected by the rudder angle sensor as an initial target rudder angle at predetermined time intervals and compute a target rudder angle based on the initial target rudder angle and the change in the rotation angle of the steering wheel, and to control the actuator to change the rudder angle of the rudder unit in accordance with the target rudder angle.

5. A marine vessel comprising:

a hull; and a marine vessel steering apparatus according to claim 1 provided on the hull.

6. A marine vessel steering apparatus comprising:

a rudder unit arranged to be mounted pivotally on a hull;

an actuator arranged to turn the rudder unit;

a rudder angle sensor arranged to detect a rudder angle of the rudder unit;

a steering wheel arranged to be operated by an operator to steer the rudder unit;

a wheel angle detecting unit arranged to detect an amount of change in a rotation angle of the steering wheel; and a control unit arranged to perform a steering control operation by which the control unit controls the actuator based on values detected by the rudder angle sensor and the wheel angle detecting unit; wherein the control unit is arranged to set the rudder angle of the rudder unit detected by the rudder angle sensor at a start of the steering control operation corresponding to the steering wheel as an initial target rudder angle and compute a target rudder angle based on the initial target rudder angle and the change in the rotation angle of the steering wheel, and to control the actuator to change the rudder angle of the rudder unit in accordance with the target rudder angle;

a plurality of steering wheels are provided; and the start of the steering control operation includes a time period when steering control corresponding to one of the plurality of steering wheels is switched to steering control corresponding to another steering wheel.

7. The marine vessel steering apparatus according to claim 6, wherein the steering wheels include a first steering wheel and a second steering wheel that are arranged independently pivotally of each other, and the wheel angle detecting unit includes a first wheel angle detecting unit arranged to detect an amount of change in a rotation angle of the first steering wheel and a second wheel angle detecting unit arranged to detect an amount of change in a rotation angle of the second steering wheel;

the apparatus further comprising a switching unit arranged to be operated by the operator to instruct the control unit to switch between a first steering control operation in which the actuator is controlled based on a value detected by the first wheel angle detecting unit and a second steering control operation in which the actuator is controlled based on a value detected by the second wheel angle detecting unit; wherein the control unit is arranged, when instructed by the switching unit to switch from the first steering control operation to the second steering control operation, to set the rudder angle of the rudder unit detected by the rudder angle sensor as an initial target rudder angle when switching and compute a target rudder angle based on the initial target rudder angle and the change in the rotation angle of the second steering wheel, and to control the actuator to change the rudder angle of the rudder unit in accordance with the target rudder angle.

8. The marine vessel steering apparatus according to claim 6, wherein the rudder unit is arranged to hold the rudder angle thereof when the steering control operation is in a stopped state, and at least one of the plurality of steering wheels is arranged to be rotatable independently of the rudder angle of the rudder unit when the steering control operation corresponding to the steering wheel is in a stopped state.

9. The marine vessel steering apparatus according to claim 6, further comprising a locking mechanism arranged to lock the rotation of at least one of the plurality of steering wheels, wherein the control unit is arranged, when the rudder angle of the rudder unit detected by the rudder angle sensor is out of a preset angular range, to control the locking mechanism to lock the at least one of the plurality of steering wheels regardless of a rotational position of the steering wheel.

10. The marine vessel steering apparatus according to claim 6, wherein the control unit is arranged, after the start of the steering control operation corresponding to at least one of the plurality of steering wheels, to reset the rudder angle of the rudder unit detected by the rudder angle sensor as an initial target rudder angle at predetermined time intervals and compute a target rudder angle based on the initial target rudder angle and the change in the rotation angle of the at least one of the plurality of steering wheels, and to control the actuator to change the rudder angle of the rudder unit in accordance with the target rudder angle.

11. A marine vessel comprising:

a hull; and a marine vessel steering apparatus according to claim 6 provided on the hull.

12. A marine vessel steering apparatus comprising:

a rudder unit arranged to be mounted pivotally on a hull;

an actuator arranged to turn the rudder unit;

a rudder angle sensor arranged to detect a rudder angle of the rudder unit;

a steering wheel arranged to be operated by an operator to steer the rudder unit;

a wheel angle detecting unit arranged to detect an amount of change in a rotation angle of the steering wheel; and a control unit arranged to perform a steering control operation by which the control unit controls the actuator based on values detected by the rudder angle sensor and the wheel angle detecting unit; wherein the control unit is arranged to set the rudder angle of the rudder unit detected by the rudder angle sensor at a start of the steering control operation corresponding to the steering wheel as an initial target rudder angle and compute a target rudder angle based on the initial target rudder angle and the change in the rotation angle of the steering wheel, and to control the actuator to change the rudder angle of the rudder unit in accordance with the target rudder angle; and the rudder unit is arranged to hold the rudder angle thereof when the steering control operation is in a stopped state, and the steering wheel is arranged to be rotatable independently of the rudder angle of the rudder unit when the steering control operation corresponding to the steering wheel is in a stopped state.

13. The marine vessel steering apparatus according to claim 12, wherein the start of the steering control operation includes a time period when the marine vessel steering apparatus is powered on and when the control unit is stopped temporarily and then restarted.

14. The marine vessel steering apparatus according to claim 12, wherein a plurality of steering wheels are provided; and the start of the steering control operation includes a time period when steering control corresponding to one of the plurality of steering wheels is switched to steering control corresponding to another steering wheel.

15. The marine vessel steering apparatus according to claim 14, wherein the steering wheels include a first steering wheel and a second steering wheel that are arranged independently pivotally of each other, and the wheel angle detecting unit includes a first wheel angle detecting unit arranged to detect an amount of change in a rotation angle of the first steering wheel and a second wheel angle detecting unit arranged to detect an amount of change in a rotation angle of the second steering wheel;

the apparatus further comprising a switching unit arranged to be operated by the operator to instruct the control unit to switch between a first steering control operation in which the actuator is controlled based on a value detected by the first wheel angle detecting unit and a second steering control operation in which the actuator is controlled based on a value detected by the second wheel angle detecting unit; wherein the control unit is arranged, when instructed by the switching unit to switch from the first steering control operation to the second steering control operation, to set the rudder angle of the rudder unit detected by the rudder angle sensor as an initial target rudder angle when switching and compute a target rudder angle based on the initial target rudder angle and the change in the rotation angle of the second steering wheel, and to control the actuator to change the rudder angle of the rudder unit in accordance with the target rudder angle.

16. The marine vessel steering apparatus according to claim 12, further comprising a locking mechanism arranged to lock the rotation of the steering wheel, wherein the control unit is arranged, when the rudder angle of the rudder unit detected by the rudder angle sensor is out of a preset angular range, to control the locking mechanism to lock the steering wheel regardless of a rotational position of the steering wheel.

17. The marine vessel steering apparatus according to claim 12, wherein the control unit is arranged, after the start of the steering control operation corresponding to the steering wheel, to reset the rudder angle of the rudder unit detected by the rudder angle sensor as an initial target rudder angle at predetermined time intervals and compute a target rudder angle based on the initial target rudder angle and the change in the rotation angle of the steering wheel, and to control the actuator to change the rudder angle of the rudder unit in accordance with the target rudder angle.

18. A marine vessel comprising:

a hull; and a marine vessel steering apparatus according to claim 12 provided on the hull.

19. A marine vessel steering apparatus comprising:

a rudder unit arranged to be mounted pivotally on a hull;

an actuator arranged to turn the rudder unit;

a rudder angle sensor arranged to detect a rudder angle of the rudder unit;

a steering wheel arranged to be operated by an operator to steer the rudder unit;

a wheel angle detecting unit arranged to detect an amount of change in a rotation angle of the steering wheel; and a control unit arranged to perform a steering control operation by which the control unit controls the actuator based on values detected by the rudder angle sensor and the wheel angle detecting unit; wherein the control unit is arranged to set the rudder angle of the rudder unit detected by the rudder angle sensor at a start of the steering control operation corresponding to the steering wheel as an initial target rudder angle and compute a target rudder angle based on the initial target rudder angle and the change in the rotation angle of the steering wheel, and to control the actuator to change the rudder angle of the rudder unit in accordance with the target rudder angle; and the marine vessel steering apparatus further comprises a locking mechanism arranged to lock the rotation of the steering wheel, wherein the control unit is arranged, when the rudder angle of the rudder unit detected by the rudder angle sensor is out of a preset angular range, to control the locking mechanism to lock the steering wheel regardless of a rotational position of the steering wheel.

20. The marine vessel steering apparatus according to claim 19, wherein the start of the steering control operation includes a time period when the marine vessel steering apparatus is powered on and when the control unit is stopped temporarily and then restarted.

21. The marine vessel steering apparatus according to claim 19, wherein a plurality of steering wheels are provided; and the start of the steering control operation includes a time period when steering control corresponding to one of the plurality of steering wheels is switched to steering control corresponding to another steering wheel.

22. The marine vessel steering apparatus according to claim 21, wherein the steering wheels include a first steering wheel and a second steering wheel that are arranged independently pivotally of each other, and the wheel angle detecting unit includes a first wheel angle detecting unit arranged to detect an amount of change in a rotation angle of the first steering wheel and a second wheel angle detecting unit arranged to detect an amount of change in a rotation angle of the second steering wheel;

the apparatus further comprising a switching unit arranged to be operated by the operator to instruct the control unit to switch between a first steering control operation in which the actuator is controlled based on a value detected by the first wheel angle detecting unit and a second steering control operation in which the actuator is controlled based on a value detected by the second wheel angle detecting unit; wherein the control unit is arranged, when instructed by the switching unit to switch from the first steering control operation to the second steering control operation, to set the rudder angle of the rudder unit detected by the rudder angle sensor as an initial target rudder angle when switching and compute a target rudder angle based on the initial target rudder angle and the change in the rotation angle of the second steering wheel, and to control the actuator to change the rudder angle of the rudder unit in accordance with the target rudder angle.

23. The marine vessel steering apparatus according to claim 19, wherein the rudder unit is arranged to hold the rudder angle thereof when the steering control operation is in a stopped state, and the steering wheel is arranged to be rotatable independently of the rudder angle of the rudder unit when the steering control operation corresponding to the steering wheel is in a stopped state.

24. The marine vessel steering apparatus according to claim 19, wherein the control unit is arranged, after the start of the steering control operation corresponding to the steering wheel, to reset the rudder angle of the rudder unit detected by the rudder angle sensor as an initial target rudder angle at predetermined time intervals and compute a target rudder angle based on the initial target rudder angle and the change in the rotation angle of the steering wheel, and to control the actuator to change the rudder angle of the rudder unit in accordance with the target rudder angle.

25. A marine vessel comprising:

a hull; and a marine vessel steering apparatus according to claim 19 provided on the hull.

26. A marine vessel steering apparatus comprising:

a rudder unit arranged to be mounted pivotally on a hull;

an actuator arranged to turn the rudder unit;

a rudder angle sensor arranged to detect a rudder angle of the rudder unit;

a steering wheel arranged to be operated by an operator to steer the rudder unit;

a wheel angle detecting unit arranged to detect an amount of change in a rotation angle of the steering wheel; and a control unit arranged to perform a steering control operation by which the control unit controls the actuator based on values detected by the rudder angle sensor and the wheel angle detecting unit; wherein the control unit is arranged to set the rudder angle of the rudder unit detected by the rudder angle sensor at a start of the steering control operation corresponding to the steering wheel as an initial target rudder angle and compute a target rudder angle based on the initial target rudder angle and the change in the rotation angle of the steering wheel, and to control the actuator to change the rudder angle of the rudder unit in accordance with the target rudder angle; and the control unit is arranged, after the start of the steering control operation corresponding to the steering wheel, to reset the rudder angle of the rudder unit detected by the rudder angle sensor as an initial target rudder angle at predetermined time intervals and compute a target rudder angle based on the initial target rudder angle and the change in the rotation angle of the steering wheel, and to control the actuator to change the rudder angle of the rudder unit in accordance with the target rudder angle.

27. The marine vessel steering apparatus according to claim 26, wherein the start of the steering control operation includes a time period when the marine vessel steering apparatus is powered on and when the control unit is stopped temporarily and then restarted.

28. The marine vessel steering apparatus according to claim 26, wherein a plurality of steering wheels are provided; and the start of the steering control operation includes a time period when steering control corresponding to one of the plurality of steering wheels is switched to steering control corresponding to another steering wheel.

29. The marine vessel steering apparatus according to claim 28, wherein the steering wheels include a first steering wheel and a second steering wheel that are arranged independently pivotally of each other, and the wheel angle detecting unit includes a first wheel angle detecting unit arranged to detect an amount of change in a rotation angle of the first steering wheel and a second wheel angle detecting unit arranged to detect an amount of change in a rotation angle of the second steering wheel;

the apparatus further comprising a switching unit arranged to be operated by the operator to instruct the control unit to switch between a first steering control operation in which the actuator is controlled based on a value detected by the first wheel angle detecting unit and a second steering control operation in which the actuator is controlled based on a value detected by the second wheel angle detecting unit; wherein the control unit is arranged, when instructed by the switching unit to switch from the first steering control operation to the second steering control operation, to set the rudder angle of the rudder unit detected by the rudder angle sensor as an initial target rudder angle when switching and compute a target rudder angle based on the initial target rudder angle and the change in the rotation angle of the second steering wheel, and to control the actuator to change the rudder angle of the rudder unit in accordance with the target rudder angle.

30. The marine vessel steering apparatus according to claim 26, wherein the rudder unit is arranged to hold the rudder angle thereof when the steering control operation is in a stopped state, and the steering wheel is arranged to be rotatable independently of the rudder angle of the rudder unit when the steering control operation corresponding to the steering wheel is in a stopped state.

31. The marine vessel steering apparatus according to claim 26, further comprising a locking mechanism arranged to lock the rotation of the steering wheel, wherein the control unit is arranged, when the rudder angle of the rudder unit detected by the rudder angle sensor is out of a preset angular range, to control the locking mechanism to lock the steering wheel regardless of a rotational position of the steering wheel.

32. A marine vessel comprising:

a hull; and a marine vessel steering apparatus according to claim 26 provided on the hull.

* * * * *